US012522901B2

(12) United States Patent
Wang

(10) Patent No.: US 12,522,901 B2
(45) Date of Patent: Jan. 13, 2026

(54) SPHEROIDAL GRAPHITE CAST IRON, CAST ARTICLE AND AUTOMOBILE STRUCTURE PART MADE THEREOF, AND METHOD FOR PRODUCING SPHEROIDAL GRAPHITE CAST IRON ARTICLE

(71) Applicant: PROTERIAL, LTD., Tokyo (JP)

(72) Inventor: Lin Wang, Moka (JP)

(73) Assignee: PROTERIAL, LTD., Tokyo (JP)

( * ) Notice: Subject to any disclaimer, the term of this patent is extended or adjusted under 35 U.S.C. 154(b) by 54 days.

(21) Appl. No.: 18/235,572

(22) Filed: Aug. 18, 2023

(65) Prior Publication Data

US 2023/0392237 A1 Dec. 7, 2023

Related U.S. Application Data

(62) Division of application No. 16/084,333, filed as application No. PCT/JP2017/012066 on Mar. 24, 2017, now abandoned.

(30) Foreign Application Priority Data

Mar. 24, 2016 (JP) ..... 2016-059963

(51) Int. Cl.
*C22C 37/04* (2006.01)
*C21C 1/10* (2006.01)
(Continued)

(52) U.S. Cl.
CPC ..... *C22C 37/04* (2013.01); *C21C 1/10* (2013.01); *C22C 33/10* (2013.01); *C22C 37/10* (2013.01)

(58) Field of Classification Search
CPC ..... C22C 37/04
See application file for complete search history.

(56) References Cited

U.S. PATENT DOCUMENTS 3,842,893 A * 10/1974 Booth ..... B22D 18/04 164/155.6
4,527,608 A * 7/1985 Bak ..... B22D 1/007 164/58.1
(Continued)

FOREIGN PATENT DOCUMENTS

CN 105179201 A * 12/2015
JP 61-137665 A 6/1986
(Continued)

OTHER PUBLICATIONS

Alonso, G. & Stefanescu, Doru & Suárez, R. & Loizaga, A. & Zarrabeitia, Gorka. (2014). Kinetics of Graphite Expansion during the Eutectic Solidification of Cast Iron. International Journal of Cast Metals Research. 27. 87-100. 10.1179/1743133613Y.0000000085. (Year: 2014).*
(Continued)

*Primary Examiner* — Keith Walker
*Assistant Examiner* — Catherine P Smith
(74) *Attorney, Agent, or Firm* — Sughrue Mion, PLLC

(57) ABSTRACT

A spheroidal graphite cast iron meeting $N_{(5-)} \geq 250$, $N_{(5-20)}/N_{(5-)} \geq 0.6$, and $N_{(30-)}/N_{(5-)} \leq 0.2$, wherein $N_{(5-)}$ represents the number (/mm$^2$) of graphite particles having equivalent-circle diameters of 5 μm or more, $N_{(5-20)}$ represents the number (/mm$^2$) of graphite particles having equivalent-circle diameters of 5 μm or more and less than 20 μm, and $N_{(30-)}$ represents the number (/mm$^2$) of graphite particles having equivalent-circle diameters of 30 μm or more, among graphite particles observed in an arbitrary cross section of at least 1 mm$^2$.

13 Claims, 10 Drawing Sheets

(51) Int. Cl.
*C22C 33/10* (2006.01)
*C22C 37/10* (2006.01)

(56) References Cited

U.S. PATENT DOCUMENTS

| | | | | |
|---|---|---|---|---|
| 4,572,751 | A | 2/1986 | Oguri et al. | |
| 4,889,687 | A | 12/1989 | Ishihara et al. | |
| 5,100,612 | A | 3/1992 | Obata et al. | |
| 5,205,856 | A | 4/1993 | Prinz et al. | |
| 5,387,275 | A | 2/1995 | Tissier et al. | |
| 5,954,113 | A * | 9/1999 | Buchborn | B22D 27/09 164/285 |
| 2005/0050992 | A1 | 3/2005 | Loper, Jr. et al. | |
| 2012/0279349 | A1 * | 11/2012 | Cobos Jimenez | C22C 37/00 164/250.1 |
| 2014/0271330 | A1 | 9/2014 | Horiya et al. | |
| 2014/0352851 | A1 | 12/2014 | Wang et al. | |
| 2016/0144425 | A1 * | 5/2016 | Kawabata | B22D 27/09 164/120 |
| 2016/0160325 | A1 | 6/2016 | Mito et al. | |
| 2019/0071756 | A1 | 3/2019 | Wang | |

FOREIGN PATENT DOCUMENTS

| | | | | |
|---|---|---|---|---|
| JP | 64-246 | A | | 1/1989 |
| JP | 01180769 | A | * | 7/1989 |
| JP | 10-317093 | A | | 12/1998 |
| JP | 2001-347357 | A | | 12/2001 |
| JP | 2004082211 | A | * | 3/2004 |
| JP | 2007-000881 | A | | 1/2007 |
| WO | 2013100148 | A1 | | 7/2013 |
| WO | 2014/208240 | A1 | | 12/2014 |
| WO | WO-2014203966 | A1 * | | 12/2014 B22D 18/04 |

OTHER PUBLICATIONS

JP 01180769 A English Machine Translation (Year: 1989).*
JP 2004082211 A English Machine Translation (Year: 2004).*
CN 105179201 A English Machine translation (Year: 2015).*
Stefanescu, D.M. Thermal Analysis—Theory and Applications in Metalcasting. Inter Metalcast 9, 7-22 (2015). https://doi.org/10.1007/BF03355598 (Year: 2015).*
International Search Report of PCT/JP2017/012066 dated Jun. 27, 2017 [PCT/ISA/210].
Karl Martin Pedersen, et al., "Graphite Nodule Count and Size Distribution in Thin-Walled Ductile Cast Iron", Material Characterization, Elsevier, New York, NY, US, 2008, vol. 59, No. 8, pp. 1111-1121 (11 pages total).
Torbjørn Skaland, "A New Method For Chill And Shrinkage Control In Ladle Treated Ductile Iron," Foundry Trade Journal (UK), 2004, pp. 396-400, vol. 178, No. 3620.
Communication dated Mar. 31, 2021 from the Indian Intellectual Property Office in Application No. 201817035819.
Communication dated Jul. 5, 2019, from the European Patent Office in counterpart European Application No. 17770422.8.
Kurt Wiencek, et al., "Graphite Particle Size Distribution in Nodular Cast Iron", Metallurgy and Foundry Engineering, 2005, vol. 31, No. 2, pp. 167-173 (7 pages total).
H. Khodaverdizadeh, "Effects of applied pressure on microstructure and mechanical properties of squeeze cast ductile iron", Materials & Design, vol. 32, Issue 10, 2011, p. 4747-4755 (Year: 2011).
https://thelibraryofmanufacturing.com/pressure_casting.html (Year: 2015).

* cited by examiner

SPHEROIDAL GRAPHITE CAST IRON, CAST ARTICLE AND AUTOMOBILE STRUCTURE PART MADE THEREOF, AND METHOD FOR PRODUCING SPHEROIDAL GRAPHITE CAST IRON ARTICLE

CROSS REFERENCE TO RELATED APPLICATIONS

This application is a divisional of application Ser. No. 16/084,333 filed Sep. 12, 2018, which is a National Stage of International Application No. PCT/JP2017/012066, filed Mar. 24, 2017, claiming priority based on Japanese Patent Application No. 2016-059963, filed Mar. 24, 2016. The disclosure of application Ser. No. 16/084,333 is herein incorporated by reference.

FIELD OF THE INVENTION

The present invention relates to a spheroidal graphite cast iron, a cast article and an automobile structure part made thereof, and a method for producing a spheroidal graphite cast iron article.

BACKGROUND OF THE INVENTION

To improve the mechanical properties, particularly toughness, of spheroidal graphite cast iron articles, it is important to increase crystallized spheroidal graphite, particularly fine spheroidal graphite.

For example, U.S. Pat. No. 5,205,856 discloses a spheroidal graphite cast iron with the average particle size of spheroidal graphite drastically decreased and the number of graphite particles increased from 511/mm$^2$ to 1256/mm$^2$ by treatment with a wire inoculant comprising powdery ferrosilicon and powdery magnesium silicide (see FIG. 3). This spheroidal graphite cast iron comprises spheroidal graphite having the maximum diameter of 32.5 μm, 90% or more of which is occupied by spheroidal graphite having diameters of 12.5 μm or less. The invention of U.S. Pat. No. 5,205,856 presumably intends to use magnesium silicide in the wire inoculant as nuclei for crystallizing graphite, but when the wire inoculant is excessively added to the melt to increase nuclei for graphite, metal silicon formed from the simultaneously added ferrosilicon likely remains in the solidified cast article, extremely deteriorating the ductility of the cast article.

Torjorn Skaland, "A New Method For Chill And Shrinkage Control in Ladle Treated Ductile Iron," Foundry Trade Journal (UK), 2004, Volume 178 (No. 3620), pp. 396-400 reports the research of spheroidal graphite in disc-shaped spheroidal graphite cast iron products treated with spheroidizing agents containing various rare earth metals, which may be called REMs below. It describes that spheroidization with spheroidizing agents comprising 0.5% of La and 1.0% of La (containing substantially no other RE components such as Ce, etc.), respectively, added to magnesium ferrosilicon containing 45% of FeSi, 6% of Mg, 1% of Ca, and 0.9% of Al, increases the number of graphite particles, improves the sphericity of graphite particles, and provides a non-symmetrical particle size distribution higher in smaller particle sizes. It describes, however, that 5-mm-thick castings obtained by using spheroidizing agents containing of La and 1.0% of La, respectively, have hard chill (eutectic cementite), meaning that when structure parts of automobiles having 5-mm-thick portions are formed, they may not have sufficient ductility.

OBJECT OF THE INVENTION

An object of the present invention is to provide a spheroidal graphite cast iron having a higher percentage of fine graphite than in conventional spheroidal graphite cast irons of the above prior art references, etc., thereby having excellent mechanical properties, particularly toughness, a cast article and an automobile structure part of the spheroidal graphite cast iron, and a method for producing a spheroidal graphite cast iron article.

SUMMARY OF THE INVENTION

As a result of intensive research in view of the above object, the inventor has found that a spheroidal graphite cast iron containing graphite particles having a particular particle size distribution has excellent mechanical properties, particularly toughness. The present invention has been completed based on such finding.

Thus, the spheroidal graphite cast iron of the present invention meets $$N_{(5-)} \geq 250,$$

$$N_{(5-20)}/N_{(5-)} \geq 0.6, \text{ and}$$

$$N_{(30-)}/N_{(5-)} \leq 0.2,$$

wherein $N_{(5-)}$ represents the number (/mm$^2$) of graphite particles having equivalent-circle diameters of 5 μm or more, $N_{(5-20)}$ represents the number (/mm$^2$) of graphite particles having equivalent-circle diameters of 5 μm or more and less than 20 μm, and $N_{(30-)}$ represents the number (/mm$^2$) of graphite particles having equivalent-circle diameters of 30 μm or more, among graphite particles observed in an arbitrary cross section of at least 1 mm$^2$.

The spheroidal graphite cast iron of the present invention preferably meets $N_{(2-5)} \geq 100$, wherein $N_{(2-5)}$ represents the number (/mm$^2$) of graphite particles having equivalent-circle diameters of 2 μm or more and less than 5 μm.

The spheroidal graphite cast iron of the present invention preferably meets $N_{(5-20)}/N_{(5-)} \geq 0.65$.

The spheroidal graphite cast iron of the present invention preferably meets $D_{max} \geq 50.4$ μm, wherein $D_{max}$ represents the maximum equivalent-circle diameter of graphite particles.

The spheroidal graphite cast iron of the present invention preferably meets $$-0.15 \leq [N_{(5-10)} - N_{(15-20)}]/N_{(5-10)} \geq 0.25,$$

wherein $N_{(5-10)}$ represents the number (/mm$^2$) of graphite particles having equivalent-circle diameters of 5 μm or more and less than 10 μm, and $N_{(15-20)}$ represents the number (/mm$^2$) of graphite particles having equivalent-circle diameters of 15 μm or more and less than 20 μm.

The cast article of the present invention is made of the above spheroidal graphite cast iron.

The cast articles are preferably automobile structure parts.

The method of the present invention for producing a spheroidal graphite cast iron article meeting the following conditions of $$N_{(5-)} \geq 250,$$

$$N_{(5-20)}/N_{(5-)} \geq 0.6, \text{ and}$$

$$N_{(30-)}/N_{(5-)} \leq 0.2,$$

wherein $N_{(5-)}$, $N_{(5-20)}$ and $N_{(30-)}$ represent the number (/mm$^2$) of graphite particles having equivalent-circle diameters of 5 μm or more, the number (/mm$^2$) of graphite particles having equivalent-circle diameters of 5 μm or more and less than 20 μm, and the number (/mm$^2$) of graphite particles having equivalent-circle diameters of 30 μm or more, respectively, among graphite particles observed in arbitrary cross section of at least 1 mm$^2$; comprising pressing a surface of a melt poured into a gas-permeable casting mold by a gas at a pressure of 1-100 kPa, before the melt starts eutectic solidification, and solidifying the melt while supplying the gas into the casting mold.

The pressure is preferably 10-50 kPa.

The method of the present invention preferably meets $$0 \leq dt_{pE}/dt_E \leq 1,$$

wherein $dt_E$ represents a time period from the start of eutectic solidification of the melt to the completion of the eutectic solidification, and $dt_{pE}$ represents a time period from the start of eutectic solidification of the melt to the completion of the pressing.

EFFECTS OF THE INVENTION

Because the spheroidal graphite cast iron of the present invention contains graphite particles with a high percentage of fine graphite and a particular particle size distribution, thereby having excellent mechanical properties, particularly toughness, it is suitable for spheroidal graphite cast iron articles, particularly structure parts for automobiles. The method of the present invention can produce a spheroidal graphite cast iron having excellent mechanical properties, particularly toughness.

BRIEF DESCRIPTION OF THE DRAWINGS

FIG. 2(*b*) is a cross-sectional view schematically showing a casting method conducted in Example 1.

DESCRIPTION OF THE PREFERRED EMBODIMENTS

[1] Spheroidal Graphite Cast Iron

Figure 1:
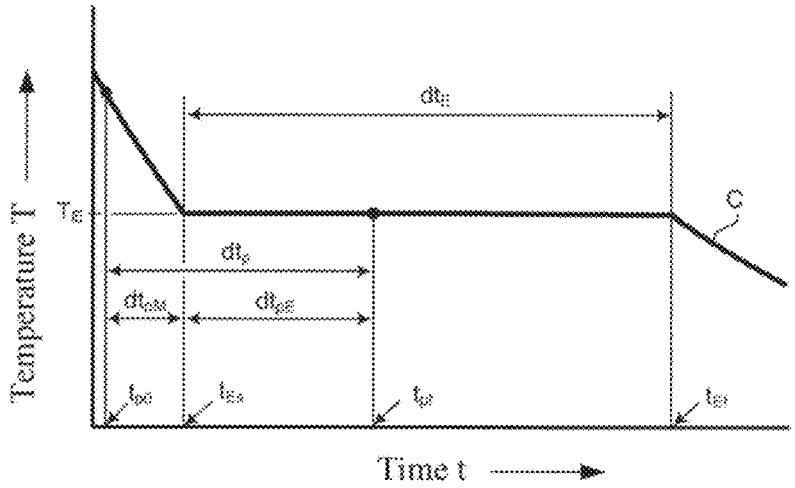
FIG. 1 is a graph showing the relation between a cooling curve and a pressing time near a eutectic solidification temperature in the production method of the present invention.

The spheroidal graphite cast iron of the present invention may have a component composition capable of forming spheroidal graphite cast iron (FCD) of JIS G 5502, austempered spheroidal graphite cast iron of JIS G 5503, spheroidal-graphite, austenitic cast iron of JIS G 5510, etc. For example, it may have a composition comprising by mass 2-4.5% of C, 0.8-6% of Si, and 0.010-0.080% of Mg, the balance being Fe and inevitable impurity elements, which may further contain elements for obtaining desired properties, such as S, P, Mn, Cu, Cr, Ni, Mo, W, etc., in proper amounts.

The spheroidal graphite cast iron of the present invention has spheroidal graphite (graphite particles) having a particle size distribution defined below. Namely, the particle size distribution of graphite particles observed in an arbitrarily cut cross section of at least 1 mm$^2$ meets $N_{(5-)} \geq 250$, $N_{(5-20)}/N_{(5-)} \geq 0.6$, and $N_{(30-)}/N_{(5-)} \leq 0.2$, wherein $N_{(5-)}$ represents the number (/mm$^2$) of graphite particles having equivalent-circle diameters of 5 μm or more, $N_{(5-20)}$ represents the number (/mm$^2$) of graphite particles having equivalent-circle diameters of 5 μm or more and less than 20 μm, and $N_{(30-)}$ represents the number (/mm$^2$) of graphite particles having equivalent-circle diameters of 30 μm or more. Thus, the spheroidal graphite cast iron of the present invention has relatively large numbers (250 or more/mm$^2$) of graphite particles having equivalent-circle diameters of 5 μm or more, with a high percentage of relatively fine graphite particles having equivalent-circle diameters of 20 μm or less, and a low percentage of relatively large graphite particles having equivalent-circle diameters of 30 μm or more. With such a structure, the spheroidal graphite cast iron can have excellent mechanical properties, particularly toughness. Particularly in as-cast articles as thick as 40 mm or more, this structure can improve toughness.

The number $N_{(5-)}$ of graphite particles having equivalent-circle diameters of 5 μm or more is preferably 300 or more/mm$^2$. A ratio $N_{(5-20)}/N_{(5-)}$ of the number of graphite particles having equivalent-circle diameters of 5 μm or more and less than 20 μm to the number of graphite particles having equivalent-circle diameters of 5 μm or more is preferably 0.65 or more, more preferably 0.70 (70%) or more, most preferably 0.75 (75%) or more. A ratio $N_{(30-)}/N_{(5-)}$ of the number of graphite particles having equivalent-circle diameters of 30 μm or more to the number of graphite particles having equivalent-circle diameters of 5 μm or more is preferably 0.15 (15%) or less, more preferably (10%) or less.

The spheroidal graphite cast iron of the present invention preferably meets $N_{(2-5)} \geq 100$, wherein $N_{(2-5)}$ represents the number (/mm$^2$) of graphite particles having equivalent-circle diameters of 2 μm or more and less than 5 μm. Such a structure having large numbers of extremely fine graphite particles preferably contributes to the improvement of toughness. $N_{(2-5)}$ is more preferably $N_{(2-5)} \geq 150$, most preferably $N_{(2-5)} \geq 200$.

The spheroidal graphite cast iron of the present invention preferably meets $D_{max} \geq 50.4$ μm, wherein $D_{max}$ represents the maximum equivalent-circle diameter of graphite particles observed in an arbitrarily cut cross section of at least 1 mm$^2$. Even when solidified at such a low cooling speed that the maximum equivalent-circle diameter $D_{max}$ of graphite particles becomes 50.4 μm or more, the spheroidal graphite cast iron contains large numbers (250 or more/mm$^2$) of graphite particles, with a high percentage of relatively fine graphite particles having equivalent-circle diameters of 20 μm or less, and a low percentage of large graphite particles having equivalent-circle diameters of 30 μm or more, thereby exhibiting excellent mechanical properties, particularly toughness.

The spheroidal graphite cast iron of the present invention preferably meets $-0.15 \leq [N_{(5-10)} - N_{(15-20)}]/N_{(5-10)} \leq 0.25$, wherein $N_{(5-10)}$ represents the number (/mm$^2$) of graphite particles having equivalent-circle diameters of 5 μm or more and less than 10 μm, and $N_{(15-20)}$ represents the number (/mm$^2$) of graphite particles having equivalent-circle diameters of 15 μm or more and less than 20 μm. Namely, another preferred feature of the spheroidal graphite cast iron of the present invention is that in a cut cross section, a ratio of the difference between the number $N_{(5-10)}$ of graphite particles having equivalent-circle diameters of 5 μm or more and less than 10 μm and the number $N_{(15-20)}$ of graphite particles having equivalent-circle diameters of 15 μm or more and less than 20 μm to the number $N_{(5-10)}$ of graphite particles having equivalent-circle diameters of 5 μm or more and less than 10 μm is −0.15 or more and 0.25 or less. This means that when graphite particles having equivalent-circle diameters of 5 μm or more and less than 20 μm are divided to every 5-μm range, there is a small difference between the number of graphite particles in a small-particle-size range (5 μm or more and less than 10 μm), and the number of graphite particles in a large-particle-size range (15 ∞m or more and less than 20 μm). Particularly in as-cast articles as thick as 50 mm or more, this structure can improve toughness.

The spheroidal graphite cast iron of the present invention preferably meets d60≤20 μm, wherein d60 (μm) represents an equivalent-circle diameter (60-% particle size) of graphite particles, at which a cumulative number of graphite particles determined by cumulating the number of graphite particles of 5 μm or more toward larger diameters is 60% of the number of graphite particles having equivalent-circle diameters of 5 μm or more. Further, it preferably meets d70≤20 μm, d80≤30 μm, and d90≤35 μm, wherein d70 (μm), d80 (μm), and d90 (μm) represent the equivalent-circle diameters of graphite particles, at which the cumulative numbers of graphite particles are 70%, 80%, and 90%, respectively, of the number of graphite particles having equivalent-circle diameters of 5 μm or more. The conditions expressed by d60≤20 μm, and d80≤30 μm are substantially the same as expressed by $N_{(5-20)}/N_{(5-)} \geq 0.6$, and $N_{(30-)}/N_{(5-)} \leq 0.2$.

[2] Production Method

The spheroidal graphite cast iron of the present invention can be produced by the following method. Each step in an example of the production methods of the present invention will be explained below.

Melt for Spheroidal Graphite Cast Iron

A melt for the spheroidal graphite cast iron, which is hereinafter referred to simply as "melt," can be prepared by a known method, for example, by mixing and melting steel scraps, return scraps and various auxiliary materials as raw materials to prepare a molten iron alloy having a desired composition, which is hereinafter called "base melt," and adding a predetermined amount of a spheroidizing agent containing Mg, etc., for example, an Fe—Si—Mg alloy, to the base melt. The usable spheroidizing agent may contain proper amounts of REM, and if necessary, other minor elements. Spheroidization can be conducted by a widely used sandwiching method, a method of supplying a cored wire containing a spheroidizing agent into a base melt in a ladle, etc.

Inoculation

Inoculation is preferably conducted when pouring the melt into a casting mold, because it increases the number of graphite particles. A usual Fe—Si alloy may be used as an inoculant. The inoculation may be conducted by known methods, such as (a) inoculation in a melt-pouring ladle simultaneously with spheroidization by a sandwiching method, which may be hereinafter called "primary inoculation," (b) inoculation by adding an inoculant to a pouring flow of a melt, (c) inoculation with an inoculant added in a cavity of a casting mold in advance, etc. The inoculations (b) and (c) may be called "secondary inoculation," which are conducted after the primary inoculation.

Production Method of Cast Article

Though a cast article of the spheroidal graphite cast iron of the present invention may be produced by known methods such as a gravity casting, etc., it is preferable to use a method of pressing a surface of a melt poured into a gas-permeable casting mold, which may be simply called as "casting mold," by a gas before the eutectic solidification of the melt starts, and solidifying the melt while supplying the gas into the casting mold, which may be hereinafter called "gas-pressing method." The gas-pressing method can easily produce spheroidal graphite cast iron having a high percentage of fine graphite particles with the percentage of coarse graphite particles suppressed. The details of the gas-pressing method, one of preferred production methods of the present invention, will be explained below.

The casting mold may be a green sand mold, a shell mold, a self-hardening mold, or other widely used gas-permeable casting molds constituted by sand particles. A casting mold constituted by ceramic particles, metal particles, etc. may also be used, as long as it has necessary gas permeability. Further, even a metal mold with no gas permeability, such as a metal die, can be used as a gas-permeable casting mold, when it is provided with gas-passing holes such as vents, etc. for gas permeability. A casting mold of gypsum, etc. with substantially no gas permeability can also be used as a gas-permeable casting mold, as long as it has sufficient gas permeability by containing a gas-permeable material, or by forming part of the mold by a gas-permeable material.

A gas supplied may be air for cost, but a non-oxidizing gas such as argon, nitrogen, carbon dioxide may be used to prevent the oxidation of the melt. The melt can be pressed by a gas supplied into the casting mold through a gate.

With the melt pressed by a gas, Mg oversaturatingly dissolved in the melt for spheroidization can be suppressed from being released from the melt, increasing Mg compounds such as MgS, MgO, etc., which form nuclei for crystallizing graphite. This method advantageously makes it easier to increase the percentage of fine graphite while decreasing the percentage of coarse graphite, than when the melt is not pressed by a gas. The pressing pressure of a gas is preferably 1-100 kPa. With the pressing pressure of less than 1 kPa, the number of graphite particles is not easily increased. On the other hand, the pressing pressure of more than 100 kPa breaks the casting mold to scatter the melt, undesirable for operation safety. The pressing pressure is more preferably 10-50 kPa, further preferably 20-40 kPa.

The relation between a time period from the start to end of pressing, which may be called "pressing time," and a eutectic solidification time period inside a cast article to be formed will be explained referring to the figures. FIG. 1 is a graph showing the relation between a cooling curve and the pressing time in a range near a eutectic solidification temperature. In FIG. 1, a curve C indicates the relation between the temperature T inside a cast article being formed and the time t. The eutectic solidification time period from a eutectic solidification start time $t_{Es}$ to a eutectic solidification termination time $t_{Ef}$ is $dt_E$ ($=t_{Ef}-t_{Es}$), during which the temperature T is substantially constant with the time t. The pressing time period from a pressing-starting time $t_{p0}$ to a pressing-terminating time $t_{pf}$ is $dt_p$ ($=tp_f-t_{p0}$).

The pressing start time may be in a time period in which a surface temperature of the melt poured into the casting mold, which comes into contact with the pressing gas, is equal to or higher than the eutectic solidification temperature $T_E$. Because a surface temperature of the melt is generally equal to or lower than the melt temperature inside a cast article being formed, and because a melt has higher fluidity at a higher temperature than the eutectic solidification temperature, pressing to the melt surface is started preferably as early as after the completion of pouring. Namely, in FIG. 1, $t_{p0} \leq t_{Es}$ need only be met, and $t_{p0} < t_{Es}$ is preferable. The pressing time period $dt_{pM}$ before the eutectic solidification start time $t_{Es}$ ($=t_{Es}-t_{p0}$) is preferably as long as possible.

The pressing termination time may be after the eutectic solidification of a cast article being formed starts, and pressing need not be continued until the eutectic solidification of the entire cast article being formed is completed. Namely, in FIG. 1, the pressing time period after the eutectic solidification start time $t_E$, which may be called "pressing time period $dt_{pE}$ after the start of eutectic solidification ($=t_{pf}-t_{Es}$)," need only meet $0 \leq dt_{pE}$ ($t_{Es} \leq t_{pf}$). A ratio of the pressing time period $dt_{pE}$ after the start of eutectic solidification to the eutectic solidification time period dt E need only be 0 or more, namely $0 \leq dt_{pE}/dt_E$. $0 \leq dt_{pE}/dt_E \leq 1$ ($t_{pf} \leq t_{Ef}$) is preferable, $0 \leq dt_{pE}/dt_E \leq 1/2$ is further preferable, and $0 \leq dt_{pE}/dt_E \leq 1/4$ is most preferable. Thus, by terminating pressing in an early stage before the completion of eutectic solidification of an entire cast article being formed, the cycle time of gas pressing in subsequent casting molds can be desirably shortened in a mass casting line. Because the pressing time period $dt_p$ ($=t_{pf}-t_{p0}$) is more than 0 in the above relation, $t_{p0}=t_{Es}=t_{pf}$ is excluded.

The eutectic solidification temperature, the eutectic solidification start time, and the eutectic solidification termination time may be measured by a thermocouple placed at a predetermined position in a casting mold in a casting experiment, etc., or determined by solidification analysis by a computer. Because the same articles are mass-produced under substantially the same casting conditions, these parameters of eutectic solidification need not be measured for every article.

Because a blown gas passes through the gas-permeable casting mold and goes outside the casting mold in the course of pressing, the cooling of the casting mold is accelerated, thereby accelerating the solidification of not only a melt surface in direct contact with the blown gas but also a melt portion in contact with the casting mold, so that a solidified shell tends to be rapidly formed in the melt from surface toward inside. In the subsequent solidification of an inner portion of the melt, expanding pressure by the crystallization of spheroidal graphite is directed not outward but inward by an already solidified shell, offsetting the shrinkage of a cooling melt, thereby suppressing the generation of shrinkage cavities. This effect makes it easy to obtain cast articles having high mechanical properties, particularly impact strength.

An arbitrary pressure pattern may be used during pressing, but the gas is preferably supplied to monotonically increase the pressing pressure from the start, thereby suppressing the evaporation of Mg from the melt and cooling the casting mold.

The method of the present invention can produce spheroidal graphite cast iron, in which graphite particles observed in an arbitrary cross section of at least 1 $mm^2$ meet $N_{(5-)} \geq 250$, $N_{(5-20)}/N_{(5-)} \geq 0.6$, and $N_{(30-)}/N_{(5-)} \leq 0.2$, wherein $N_{(5-)}$ represents the number ($/mm^2$) of graphite particles having equivalent-circle diameters of 5 μm or more, $N_{(5-20)}$ represents the number ($/mm^2$) of graphite particles having equivalent-circle diameters of 5 μm or more and less than 20 μm, and $N_{(30-)}$ represents the number ($/mm^2$) of graphite particles having equivalent-circle diameters of 30 μm or more.

The method of the present invention can also produce spheroidal graphite cast iron meeting 50.4 μm$>D_{max} \geq$15.9 μm, and d60≤10.0 μm, wherein $D_{max}$ represents the maximum equivalent-circle diameter of graphite particles, and d60 represents the equivalent-circle diameters (μm) of graphite particles, at which the cumulative number of graphite particles obtained by cumulating the number of graphite particles in the ascending order of equivalent-circle diameters is 60% of the number of graphite particles having equivalent-circle diameters of 5 μm or more.

The present invention will be explained in more detail referring to Examples below, without intention of restriction.

Example 1

Production by a gravity-casting method and a gas-pressing method according to a preferred embodiment of the present invention will be explained referring to the figures and tables, without intention of restriction.

Melt

Return scraps of spheroidal graphite cast iron, steel scraps, graphite powder, ferrosilicon, ferromanganese, ferrophosphorus, pure copper, and iron sulfide were charged in a predetermined formulation as raw materials into a high-frequency induction furnace, and melted to obtain 100 kg of a base melt. After a melt-pouring ladle having a pocket at the bottom is pre-heated, 1.05% by mass, based on the base melt, of a spheroidizing agent [Fe—Si—Mg alloy containing REM (TDCR-5 available from Toyo Denka Kogyo Co. Ltd.)] was put in the pocket of the melt-pouring ladle, 0.1% by mass, based on the base melt, of a primary inoculant [Fe—Si alloy (Caslon 75H available from Toyo Denka Kogyo Co. Ltd.)] was then put thereon, and 1300 g of punched steel scraps were further put thereon as a covering material. The base melt at 1510° C. was poured from the high-frequency induction furnace into the melt-pouring ladle, to conduct spheroidization by a sandwiching method and primary inoculation simultaneously. 0.20% by mass, as a Si equivalent, of a secondary inoculant [powdery Fe—Si alloy (Stream available from Toyo Denka Kogyo Co. Ltd.)] was then added to the melt in a casting ladle for secondary inoculation. The composition of the melt of Example 1 is shown in Table 1.

TABLE 1

| % by mass | C | Si | Mn | P | S | Cu | Mg | Fe[(1)] |
|---|---|---|---|---|---|---|---|---|
| Example 1 | 3.75 | 2.26 | 0.48 | 0.016 | 0.009 | 0.39 | 0.037 | Bal. |
| Example 2 | 3.75 | 2.26 | 0.48 | 0.016 | 0.009 | 0.39 | 0.037 | Bal. |

Note:
[(1)]Including impurity elements.

Casting Mold

Figure 2A:
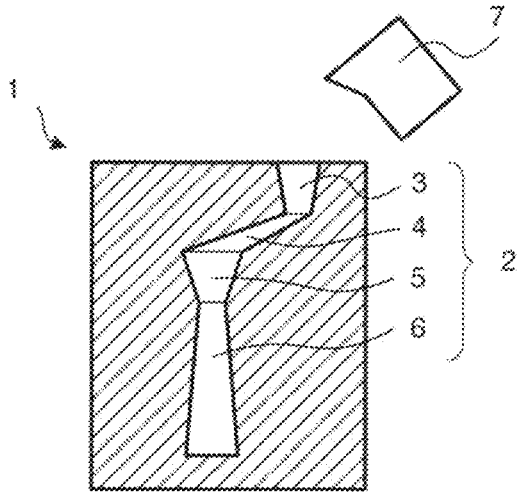
FIG. 2(*a*) is a cross-sectional view schematically showing a casting mold used in Example 1.
Figure 2B:
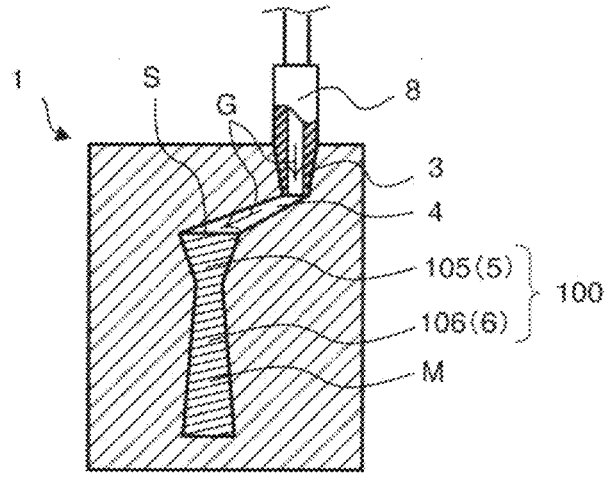

FIG. 2(*a*) shows a casting mold used in Example 1, and FIG. 2(*b*) shows a casting method in Example 1. The casting mold 1 having a cavity 2 constituted by a sprue 3, a runner 4, a riser 5 and a product-forming space 6 was a $CO_2$-hardened alkaline phenol casting mold, which was a gas-permeable casting mold constituted by silica sand as aggregate.

Casting

Figure 3:
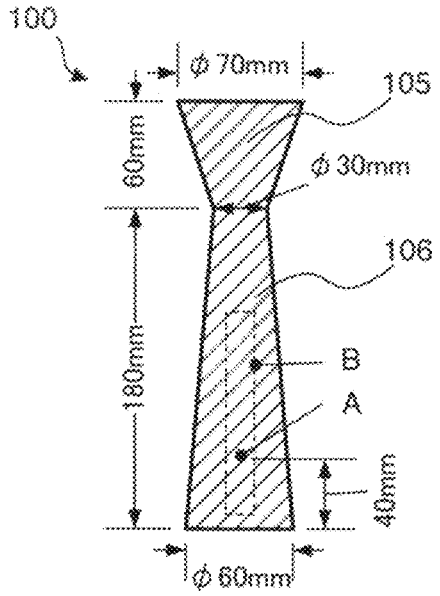
FIG. 3 is a schematic cross-sectional view showing the spheroidal graphite cast iron article of Example 1.

The casting method used was a combination of a gravity-casting method in an air atmosphere at room temperature and normal pressure outside the casting mold 1, and a gas-pressing method. The above melt M in a volume of filling the product-forming space 6 and the riser 5 was gravity-cast from the above casting ladle 7 into the cavity 2 at 1365° C. as shown in FIG. 2(*a*), a nozzle 8 for ejecting a gas G (air in Example 1 and subsequent Examples) supplied from a blower (not shown) was attached to the sprue 3 as shown in FIG. 2(*b*), and a melt surface S in the cavity 2 was then pressed by the gas G. The pressing pressure was 25 kPa, the time period from the gas-blowing start time to the time of reaching 25 kPa was 2 s, and the pressing time period was 120 s. After the melt M was solidified, as shown in FIG. 3, a spheroidal graphite cast iron article 100, in which a riser portion 105 and a product portion 106 were connected, was taken out of the casting mold 1. FIG. 3 is a schematic cross-sectional view showing the spheroidal graphite cast iron article 100, with sizes described. The pressing pressure was measured by a pressure sensor (not shown) arranged in a gas flow path of the gas nozzle 8.

Microstructure

Figure 4:
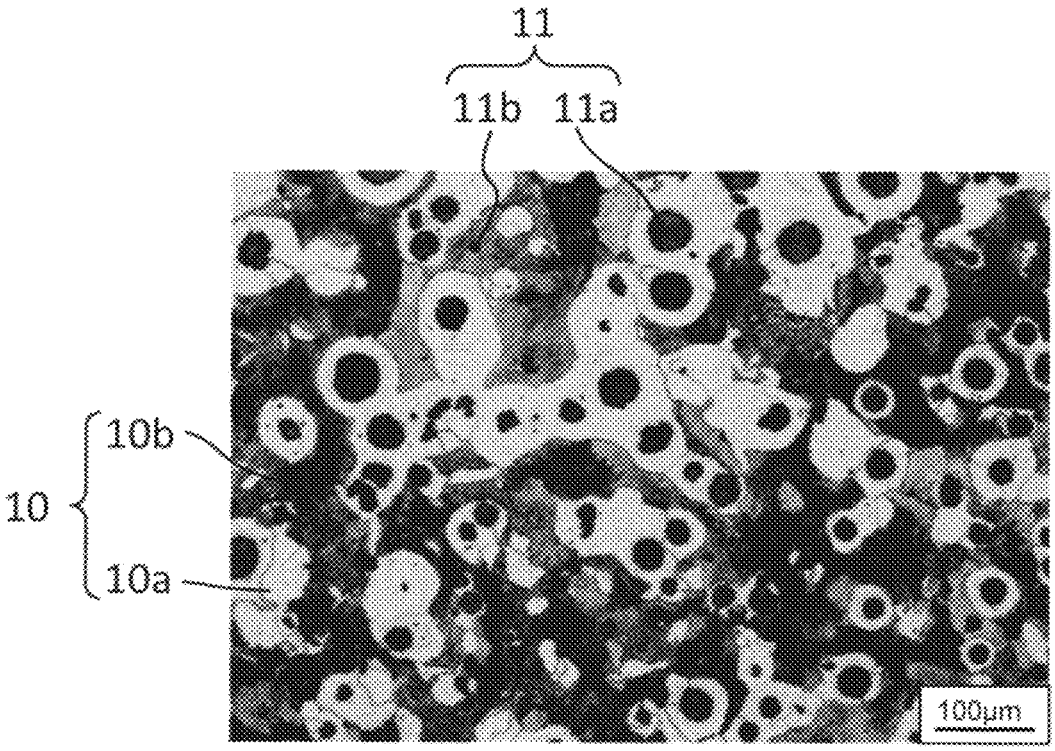
FIG. 4 is an optical photomicrograph showing the observed microstructure of the spheroidal graphite cast iron article of Example 1.

A cross section of the as-cast spheroidal graphite cast iron article 100 of Example 1 was etched to observe its microstructure by an optical microscope. An observation portion was indicated by A in FIG. 3. The diameter of a cross section passing through this portion and in parallel with the bottom surface was 53.3 mm, corresponding to a thickness of 53.3 mm. An optical photomicrograph of the etched observation portion is shown in FIG. 4. The matrix 10 was composed of ferrite 10*a* and pearlite 10*b*. Spheroidal graphite 11 included spheroidal graphite 11*a* surrounded by ferrite 10*a* to have a so-called bullseye structure, and non-bullseye spheroidal graphite 11*b*, which was surrounded by substantially only pearlite. Most of such non-bullseye spheroidal graphite 11*b* was as small as having equivalent-circle diameters of 20 μm or less.

Measurement of Equivalent-Circle Diameter and Number of Particles

The quantitative measurement of spheroidal graphite particles in the spheroidal graphite cast iron was conducted by observing a cross section structure of the spheroidal graphite cast iron by an optical microscope. An arbitrary cross section obtained by cutting near the portion A in FIG. 3 was observed by an optical microscope (magnification: 100 times), to take photographs of pluralities of fields, whose total area was 1.0 $mm^2$ or more. An image of 0.37 $mm^2$ per one field was actually observed in 5 fields (total area: 0.37 $mm^2 \times 5 = 1.85\ mm^2$) To measure the equivalent-circle diameters and the number of particles, optical microscopic observation was conducted without etching the observation surface, to make graphite particles clear in the matrix.

The resultant photograph data were image-treated to determine the number and equivalent-circle diameters of spheroidal graphite. The number (/$mm^2$) of graphite particles (or simply particles) per 1 $mm^2$ was calculated from the results, to obtain a distribution of frequency in equivalent-circle diameter ranges as shown in Table 2. The equivalent-circle diameter ranges were less than 2 μm, 2 μm or more and less than 5 μm, 5 μm or more and less than 10 μm, . . . , 45 μm or more and less than 50 μm (with 5-μm intervals between 5 μm and 50 μm), and 50 μm or more. "A-Image-Kun" available from Asahikasei Engineering Corporation was used as an image analyzer in Example 1 and subsequent Examples and Comparative Examples.

Figure 5:
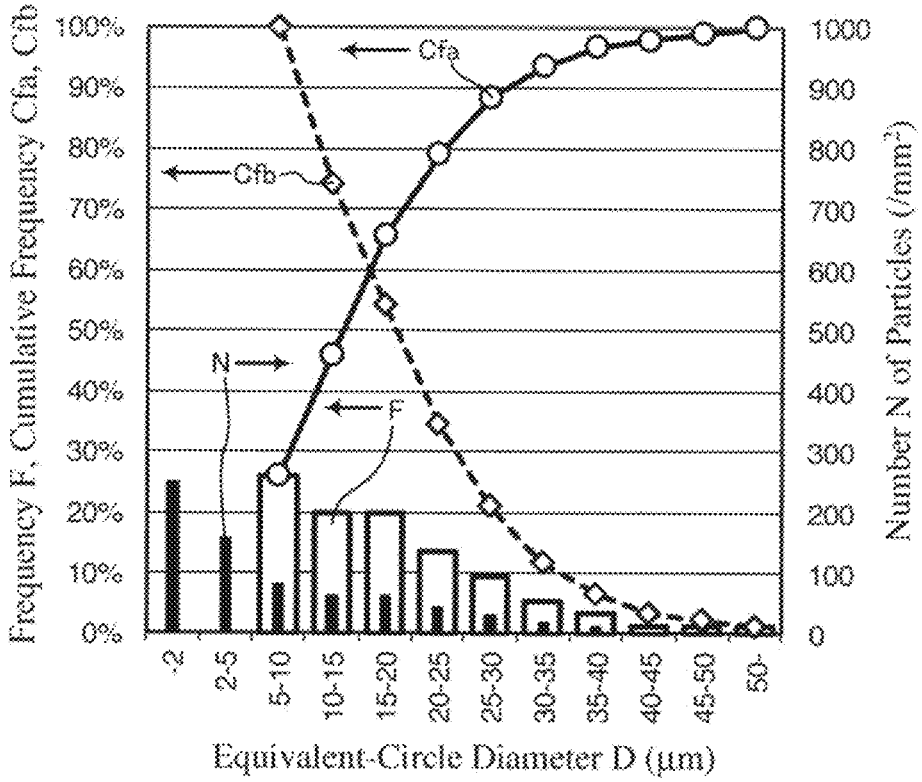
FIG. 5 is a graph showing a particle size distribution of spheroidal graphite observed in a cross section of the spheroidal graphite cast iron article of Example 1.

With respect to spheroidal graphite in the spheroidal graphite cast iron of Example 1, the number N of graphite particles, the frequency F of 5 μm or more, the cumulative frequency Cfa of 5 μm or more, and the reverse cumulative frequency Cfb in each equivalent-circle diameter range are shown in Table 2. FIG. 5 is a graph showing the data in Table 2. As shown in Table 2 and FIG. 5, in the present invention, the equivalent-circle diameter ranges are indicated by symbols "x-" for x (μm) or more, "−y" for less than y (μm), and "x-y" for x (μm) or more and less than y (μm). $N_{(x-)}$ represents the number (/$mm^2$) of particles having equivalent-circle diameters of x (μm) or more, $N_{(-y)}$ represents the number (/$mm^2$) of particles having equivalent-circle diameters of less than y (μm), and $N_{(x-y)}$ represents the number (/$mm^2$) of particles having equivalent-circle diameters of x (μm) or more and less than y (μm). A ratio $N_{(x-y)}/N_{(5-)}$ of the number $N_{(x-y)}$ of particles having equivalent-circle diameters of 5 μm or more in each equivalent-circle diameter range to the number $N_{(5-)}$ of particles having equivalent-circle diameters of 5 μm or more is expressed by $F_{(x-y)}$ (%) as a frequency F of 5 μm or more. With respect to the cumulative frequency Cfa of 5 μm or more, a cumulative frequency in each equivalent-circle diameter range, which is obtained by cumulation in the ascending order from the frequency $F_{(5-10)}$ of equivalent-circle diameters of 5 μm or more and less than 10 μm to the frequency $F_{(50-)}$ of equivalent-circle diameters 50 μm or more, is expressed by $Cfa_{(5-10)}$ (%), $Cfa_{(5-15)}$ (%), $Cfa_{(5-20)}$ (%), . . . , $Cfa_{(5-60)}$ (%), and $Cfa_{(5-)}$ (%) in the ascending order. Also, a reverse cumulative frequency Cfb in each equivalent-circle diameter range, which is obtained by cumulation in the descending order from the frequency $F_{(50-)}$ of equivalent-circle diameters 50 μm or more is expressed by $Cfb_{(60-)}$ (%), $Cfb_{(55-)}$ (%), $Cfb_{(50-)}$ (%), . . . , $Cfb_{(10-)}$ (%), and $Cfb_{(5-)}$ (%).

TABLE 2

| Example 1 | | | | |
|---|---|---|---|---|
| D(1) (μm) | N(2) (/mm$_2$) | F(3) (%) | Cfa(4) (%) | Cfb(5) (%) |
| –2 | 250 | — | — | — |
| 2-5 | 158 | — | — | — |
| 5-10 | 81.9 | 25.91 | 25.91 | 100 |
| 10-15 | 63.0 | 19.94 | 45.85 | 74.09 |
| 15-20 | 62.6 | 19.80 | 65.65 | 54.15 |
| 20-25 | 42.3 | 13.39 | 79.04 | 34.35 |
| 25-30 | 29.4 | 9.32 | 88.36 | 20.96 |
| 30-35 | 16.6 | 5.24 | 93.60 | 11.64 |
| 35-40 | 10.1 | 3.20 | 96.80 | 6.40 |
| 40-45 | 3.22 | 1.02 | 97.82 | 3.20 |
| 45-50 | 3.68 | 1.16 | 99.98 | 2.18 |
| 50- | 3.22 | 1.02 | 100 | 1.02 |
| 5- | 316 | | | |

Note:
(1)D represents an equivalent-circle diameter [x (μm) -y (μm)].
(2)N represents the number of particles.
(3)F represents the frequency of 5 μm or more.
(4)Cfa represents the cumulative frequency of 5 μm or more.
(5)Cfb represents a reverse cumulative frequency.

With respect to spheroidal graphite contained in the spheroidal graphite cast iron of Example 1, the number $N_{(5-)}$ (/mm$^2$) of graphite particles having equivalent-circle diameters of 5 μm or more, the number $N_{(5-20)}$ (/mm$^2$) of graphite particles having equivalent-circle diameters of 5 μm or more and less than 20 μm, and the number $N_{(30-)}$ (/mm$^2$) of graphite particles having equivalent-circle diameters of 30 μm or more were determined from the particle size distribution shown in Table 2, to calculate a ratio $N_{(5-20)}/N_{(5-)}$ of the number $N_{(5-20)}$ of particles having equivalent-circle diameters of 5 μm or more and less than 20 μm to the number $N_{(5-)}$ of particles having equivalent-circle diameters of 5 μm or more; a ratio $N_{(30-)}/N_{(5-)}$ of the number $N_{(30-)}$ of particles having equivalent-circle diameters of 30 μm or more to the number $N_{(5-)}$ of particles having equivalent-circle diameters of 5 μm or more; and a ratio $[N_{(5-10)}-N_{(15-20)}]/N_{(5-10)}$ of the difference between the number of graphite particles having equivalent-circle diameters of 5 μm or more and less than 10 μm and the number of graphite particles having equivalent-circle diameters of 15 μm or more and less than 20 μm to the number of graphite particles having equivalent-circle diameters of 5 μm or more and less than 10 μm. The value of $N_{(5-20)}/N_{(5-)}$ corresponds to a cumulative frequency $Cfa_{(5-20)}$ of equivalent-circle diameters of Jim or more and less than 20 μm, and the value of $N_{(30-)}/N_{(5-)}$ corresponds to a reverse cumulative frequency $Cfb_{(30-)}$ of equivalent-circle diameters 30 μm or more. The results are shown in Table 4.

With respect to spheroidal graphite contained in the spheroidal graphite cast iron of Example 1, the cumulative number (/mm$^2$) of graphite particles, which may be called simply cumulative number of particles or Nc, was determined by cumulating the number (/mm$^2$) of graphite particles in the ascending order from the equivalent-circle diameter of 5 μm to a particular equivalent-circle diameter (μm), to obtain a curve indicating the relation between the equivalent-circle diameter (μm) and the cumulative number (/mm$^2$) of graphite particles. Further, a cumulative frequency Cfa at each equivalent-circle diameter was determined with the maximum cumulative number of graphite particles [the number $N_{(5-)}$ of graphite particles having equivalent-circle diameters of 5 μm or more] as 100%, to obtain the relation between the equivalent-circle diameters (μm) and the cumulative frequency (%). The equivalent-circle diameter at a cumulative frequency of n % is expressed by dn, which may be called n-% particle diameter. For example, a 60-% particle size (d60) is the equivalent-circle diameter of graphite particles, at which the cumulative number of graphite particles is 60% of the number of graphite particles having equivalent-circle diameters of 5 μm or more.

Among observed graphite particles having equivalent-circle diameters of 5 μm or more, an equivalent-circle diameter of the minimum graphite particle is expressed by "d0" (also in subsequent Examples and Comparative Examples), and an equivalent-circle diameter of the maximum graphite particle, $D_{max}$, is expressed by "d100."

Figure 6:
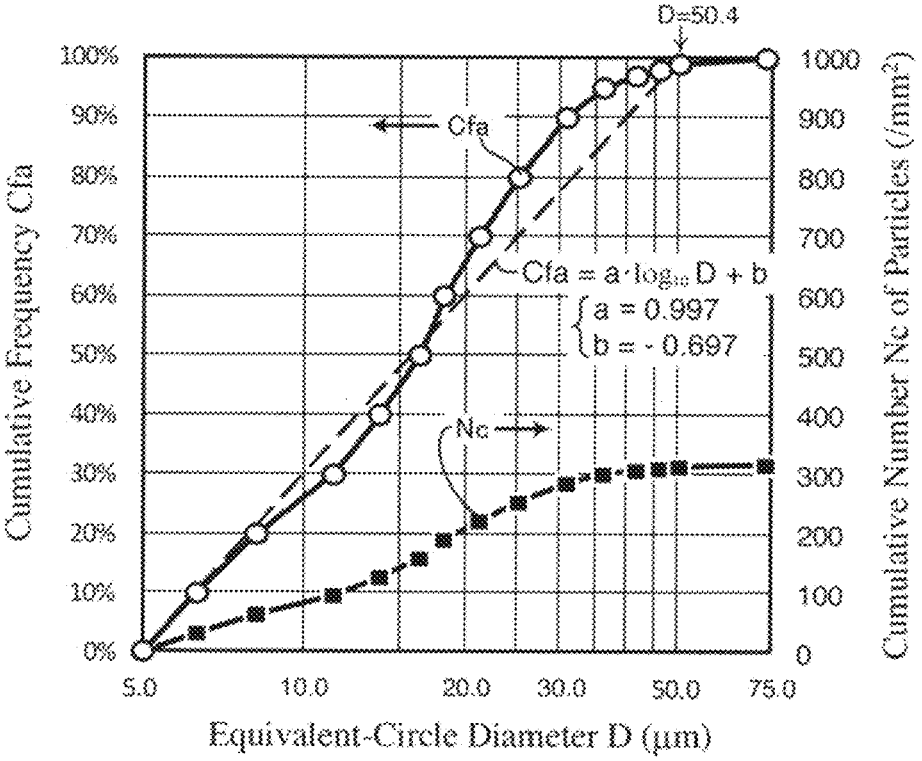
FIG. 6 is a graph showing a particle size distribution of spheroidal graphite observed in a cross section of the spheroidal graphite cast iron article of Example 1.

The results are shown in Table 3 and FIG. 6. FIG. 6 is a graph in which the cumulative number Nc of particles and the cumulative frequency Cfa of 5 μm or more are plotted against the equivalent-circle diameter shown in Table 3. The equivalent-circle diameter in the axis of abscissa is in a logarithm scale (also in subsequent Examples and Comparative Examples). In FIG. 6, for example, Cfa at an equivalent-circle diameter D=20 μm is substantially equal to $Cfa_{(15-20)}$ shown in Table 2 and FIG. 5. The $D_{max}$ (d100) of spheroidal graphite contained in the spheroidal graphite cast iron of Example 1 is extracted from Table 3, and shown in Table 4.

TABLE 3

| | D(1) (μm) | (/mm$^2$) | Cfa(3) (%) |
|---|---|---|---|
| d0 | 5.0 | 0.460 | 0.1 |
| d10 | 6.3 | 31.7 | 10 |
| d20 | 8.2 | 63.5 | 20 |
| d30 | 11.4 | 95.2 | 30 |
| d40 | 13.8 | 127 | 40 |
| d50 | 16.4 | 158 | 50 |
| d60 | 18.3 | 190 | 60 |
| d70 | 21.3 | 221 | 70 |
| d80 | 25.3 | 253 | 80 |
| d90 | 31.0 | 285 | 90 |
| d95 | 36.3 | 300 | 95 |
| d97 | 41.9 | 307 | 97 |
| d98 | 46.3 | 310 | 98 |
| d99 | 50.3 | 313 | 99 |
| d100 | 73.2 | 316 | 100 |

Note:
(1)D represents equivalent-circle diameter [x (μm) -y (μm)].
(2)Nc represents the cumulative number of particles.
(3)Cfa represents the cumulative frequency of 5 μm or more.

TABLE 4

| Parameter | Value |
|---|---|
| $N_{(5-)}$ (/mm$^2$) | 316 |
| $N_{(2-5)}$ (/mm$^2$) | 158 |
| $N_{(5-20)}/N_{(5-)}$ | 0.657 |
| $N_{(30-)}/N_{(5-)}$ | 0.117 |
| $[N_{(5-10)}-N_{(15-20)}]/N_{(5-10)}$ | 0.236 |
| $D_{max}$ (μm) | 73.2 |

The broken line in FIG. 6 is a straight line passing the coordinate points (D, Cfa)=(5, 0) and (20, 60), namely a line expressed by the formula (1): $Cfa=a\cdot\log_{10}D+b$, wherein a=0.997, and b=–0.697. The equivalent-circle diameter D at an intersection of the broken line expressed by the formula (1) and Cfa=100% is 50.4 μm. The comparison of the broken line expressed by the formula (1) with the curve of Cfa in Example 1 revealed that in Example 1, the n-% particle diameter was substantially equal to the formula (1) when Cfa was 20%, nearly up to the equivalent-circle diameter of d20, larger than the formula (1) when Cfa was 20-50%, in an equivalent-circle diameter range of d20 to d50, smaller than the formula (1) when Cfa was in a range of 50%-98% of range, and larger than the formula (1) when Cfa was 99% or more. When the particle size distribution of spheroidal graphite is along the line expressed by the formula (1), namely when the cumulative frequency Cfa is proportional to the logarithm of the equivalent-circle diameter D, it is considered that the growth of spheroidal graphite is a diffusion phenomenon (controlled by diffusion).

In Example 1, $D_{max}$ (=d100) was 73.2 μm, larger than the equivalent-circle diameter D of 50.4 μm at Cfa=100 in the formula (1). This indicates that graphite particles of d100 were not those grown by the diffusion of graphite in a physical state shown by the formula (1), but those grown in a faster graphite diffusion, for example, in a slow solidification state.

Tensile Test

Test pieces of No. 14A (JIS Z 2241) were cut out of the region B shown in FIG. 3, and the tensile strength, 0.2-% yield strength and rupture elongation of the as-cast product 106 were measured at room temperature according to JIS Z 2241 by a tensile test machine (AG-IS250kN available from Shimadzu Corporation). The test results are shown in Table 8.

Charpy Impact Test

Smooth test pieces with no notch (length: 55 mm, height: 10 mm, and width: 10 mm) for a Charpy impact test were cut out of the region B in FIG. 3, and the Charpy impact strength of the as-cast product 106 was measured according to JIS Z 2242 by a Charpy impact test machine (300CR available from Maekawa Testing Machine Mfg. Co., Ltd.). The test temperature was −30° C. The test results are shown in Table 8.

Example 2

Example 2 used only the gravity-casting method without the gas-pressing method, unlike Example 1. Example 2 used the same melt component composition as in Example 1 as shown in Table 1, under the same production conditions as in Example 1 except that the gas-pressing method was not used. The observation method of a microstructure, the methods of measuring the number and sizes of graphite particles, the tensile test method, and the Charpy impact test method were also the same as in Example 1.

Figure 7:
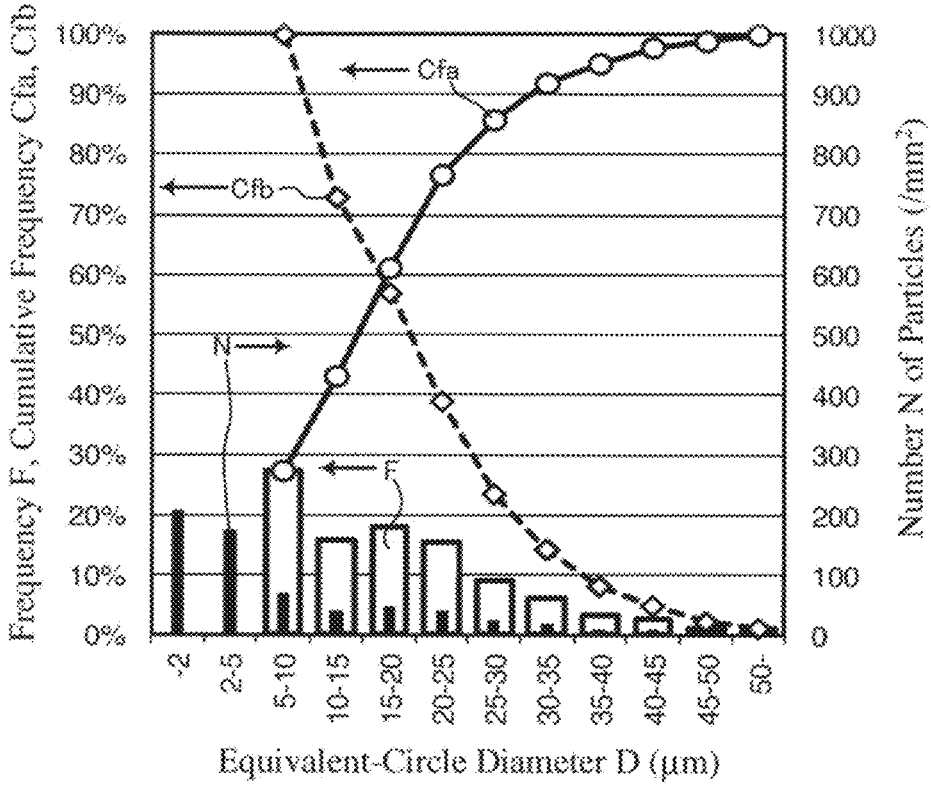
FIG. 7 is a graph showing a particle size distribution of spheroidal graphite observed in a cross section of the spheroidal graphite cast iron article of Example 2.

With respect to spheroidal graphite in the spheroidal graphite cast iron of Example 2, the measurement results of the number N of particles, the frequency F of 5 μm or more, the cumulative frequency Cfa of 5 μm or more, and the reverse cumulative frequency Cfb are shown in Table 5. FIG. 7 is a graph showing the data of Table 5.

TABLE 5

| Example 2 | | | | |
|---|---|---|---|---|
| D(1) (μm) | N(2) (/mm²) | F(3) (%) | Cfa(4) (%) | Cfb(5) (%) |
| -2 | 206 | — | — | — |
| 2-5 | 173 | — | — | — |
| 5-10 | 69.5 | 27.21 | 27.21 | 100 |
| 10-15 | 40.5 | 15.86 | 43.06 | 72.79 |
| 15-20 | 46.0 | 18.02 | 61.08 | 56.94 |
| 20-25 | 39.6 | 15.50 | 76.58 | 38.92 |
| 25-30 | 23.5 | 9.19 | 85.77 | 23.42 |
| 30-35 | 15.6 | 6.13 | 91.89 | 14.23 |
| 35-40 | 8.28 | 3.24 | 95.14 | 8.11 |
| 40-45 | 6.90 | 2.70 | 97.84 | 4.86 |

TABLE 5-continued

| Example 2 | | | | |
|---|---|---|---|---|
| D(1) (μm) | N(2) (/mm²) | F(3) (%) | Cfa(4) (%) | Cfb(5) (%) |
| 45-50 | 2.76 | 1.08 | 98.92 | 2.16 |
| 50- | 2.76 | 1.08 | 100 | 1.08 |
| 5- | 255 | | — | |

Note:
(1)D represents an equivalent-circle diameter [x (μm)-y (μm)].
(2)N represents the number of particles.
(3)F represents the frequency of 5 μm or more.
(4)Cfa represents the cumulative frequency of 5 μm or more.
(5)Cfb represents a reverse cumulative frequency.

With respect to spheroidal graphite contained in the spheroidal graphite cast iron of Example 2, $N_{(5\text{-}20)}/N_{(5\text{-})}$, $N_{(30\text{-})}/N_{(5\text{-})}$ and $[N_{(5\text{-}10)}-N_{(15\text{-}20)}]/N_{(5\text{-}10)}$ were determined from the particle size distribution shown in Table 5, in the same manner as in Example 1. The results are shown in Table 7.

As in Example 1, the relation between the equivalent-circle diameter D and the cumulative number Nc of particles, and the relation between the equivalent-circle diameter D and the cumulative frequency Cfa were determined in Example 2. The results are shown in Table 6 and FIG. 8. The $D_{max}$ (d100) of spheroidal graphite contained in the spheroidal graphite cast iron of Example 2 is extracted from Table 6, and shown in Table 7.

TABLE 6

| Equivalent-Circle Diameter D (μm) | | Cumulative Number Nc of Particles (/mm²) | Cumulative Frequency Cfa of 5 μm or More (%) |
|---|---|---|---|
| d0 | 5.0 | 0.460 | 0.2 |
| d10 | 6.4 | 25.8 | 10 |
| d20 | 8.5 | 51.1 | 20 |
| d30 | 10.6 | 76.8 | 30 |
| d40 | 13.9 | 102 | 40 |
| d50 | 17.1 | 128 | 50 |
| d60 | 19.7 | 153 | 60 |
| d70 | 22.4 | 179 | 70 |
| d80 | 26.5 | 204 | 80 |
| d90 | 33.5 | 230 | 90 |
| d95 | 39.8 | 243 | 95 |
| d97 | 43.2 | 248 | 97 |
| d98 | 45.6 | 250 | 98 |
| d99 | 50.2 | 253 | 99 |
| d100 | 62.5 | 255 | 100 |

TABLE 7

| Parameter | Value |
|---|---|
| $N_{(5\text{-})}$ (/mm²) | 255 |
| $N_{(2\text{-}5)}$ (/mm²) | 173 |
| $N_{(5\text{-}20)}/N_{(5\text{-})}$ | 0.611 |
| $N_{(30\text{-})}/N_{(5\text{-})}$ | 0.142 |
| $[N_{(5\text{-}10)}-N_{(15\text{-}20)}]/N_{(5\text{-}10)}$ | 0.338 |
| $D_{max}$ (μm) | 62.5 |

Figure 8:
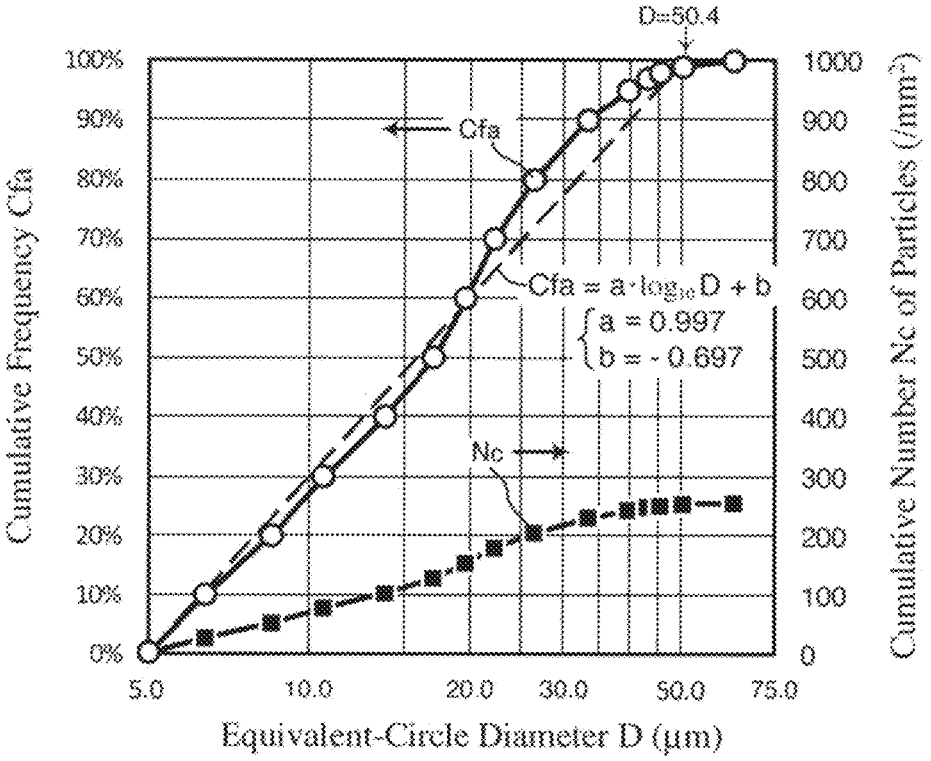
FIG. 8 is a graph showing a particle size distribution of spheroidal graphite observed in a cross section of the spheroidal graphite cast iron article of Example 2.

The comparison of the broken line expressed by the formula (1) with the curve of Cfa in Example 2 in FIG. 8 revealed that in Example 2, the n-% particle diameter was substantially equal to the formula (1) when Cfa was 10%, nearly up to the equivalent-circle diameter of d10, larger than the formula (1) when Cfa was 10-60%, in an equivalent-circle diameter range of d10 to d60, smaller than the formula (1) when Cfa was in a range of 60% to 98%, and larger than the formula (1) when Cfa was 99% or more.

Tensile Test, and Charpy Impact Test

Table 8 shows the results of the tensile test (tensile strength, 0.2-% yield strength, and rupture elongation) and the Charpy impact test of the as-cast products of Example 2.

TABLE 8

| No. | 0.2-% Yield Strength (MPa) | Tensile Strength (MPa) | Rupture Elongation (%) | Impact Strength at −30° C. (J/cm$^2$) |
|---|---|---|---|---|
| Example 1 | 351 | 593 | 10.4 | 58 |
| Example 2 | 355 | 601 | 9.1 | 44 |

Comparison of Shrinkage Cavities

The comparison of shrinkage cavities observed in the microstructures of Examples 1 and 2 revealed that substantially no shrinkage cavities were observed in Example 1, while a small number of shrinkage cavities (microporosity) were observed in Example 2.

Eutectic Solidification Time Period

Figure 9:
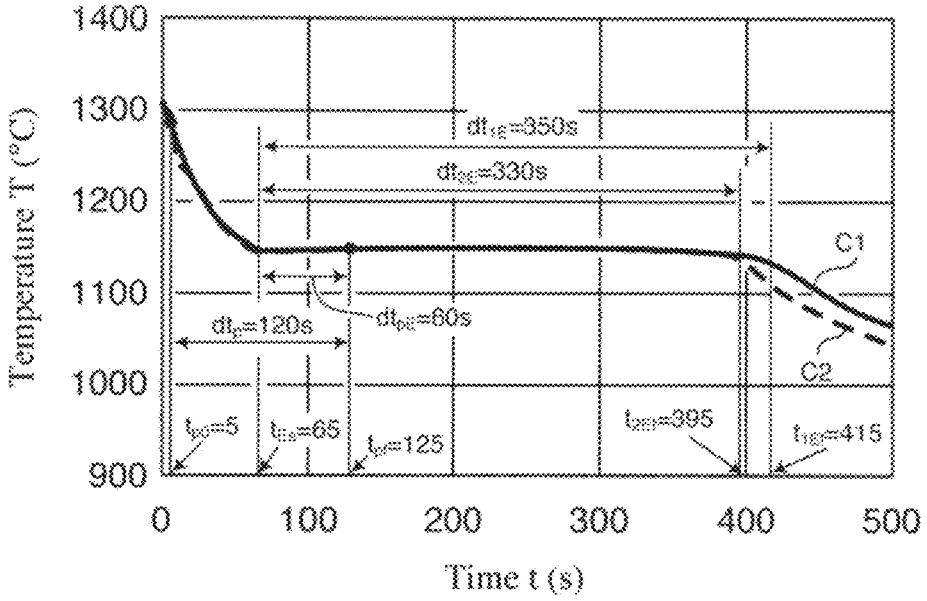
FIG. 9 is a graph showing the relation between a cooling curve and a pressing time near a eutectic solidification temperature in Examples 1 and 2.

FIG. 9 is a graph showing the relation between the cooling curves obtained by measurement in the portion A in FIG. 2 near a eutectic solidification temperature, and the pressing time, in Examples 1 and 2. The cooling curve C1 in Example 1 is shown by a solid line, and the cooling curve C2 in Example 2 is shown by a broken line. In both cooling curves, a region in which the temperature T is substantially constant with the time tin a range from 1140° C. to 1160° C. is a eutectic solidification time period. In FIG. 9, the cooling curves C1 and C2 are overlapped by setting the eutectic solidification start time t Es for them at t=65 s, for comparison of the eutectic solidification time period. With the eutectic solidification termination time regarded as a time when the temperature T was lowered to 1135° C., $t_{1Ef}$ in Example 1 was 415 s, and $t_{2Ef}$ in Example 2 was 395 s. Thus, the eutectic solidification time period $dt_{1E}$ in Example 1 was $dt_{1E}=t_{1Ef}-t_{Es}$=415 s−65 s=350 s, and the eutectic solidification time period $dt_{2E}$ in Example 2 was $dt_{2E}=t_{2Ef}-t_{Es}$=395 s−65 s=330 s. The eutectic solidification time period was longer in Example 1 than in Example 2 by 20 s. This reason is considered that in Example 1 using the gas-pressing method, pressing by a gas (air in Example 1) made Mg less saturable in the melt, suppressing the evaporation of Mg from the melt, so that more nuclei such as MgO, MgS, etc. for crystallizing spheroidal graphite were formed.

Relation Between Eutectic Solidification Time Period and Gas-Pressuring Termination Time As shown in FIG. 9, the pressing time period dt p was 120 s in Example 1. The pressing-starting time $t_{p0}$ was at t=5 s, and the pressing termination time $t_{pf}$ was at t=125 s. With the eutectic solidification start time $t_{Es}$ of 65 s as a reference, the pressing time period $dt_{pE}$ after the start of eutectic solidification was equal to $t_{pf}-t_{Es}$=60 s. Accordingly, a ratio of the pressing time period $dt_{pE}$ after the start of eutectic solidification to the eutectic solidification time period $dt_{1E}$, $dt_{pE}/dt_{1E}$, in Example 1 was 0.171, namely 1/5.8.

Example 3

Another example produced by using a gas-pressing method in addition to a gravity-casting method according to a preferred embodiment of the present invention will be explained referring to the figures and tables.

Melt

Raw materials were melted in a low-frequency induction furnace in the same manner as in Example 1, to obtain a base melt of 12000 kg. 1.1% by mass of a spheroidizing agent, 0.2% by mass of a primary inoculant, and 11 kg of punched steel scraps, based on the base melt, were then charged in this order into a pocket at the bottom of a melt-pouring ladle, in the same manner as in Example 1, and 1800 kg of the resultant base melt was poured at 1520° C. into the melt-pouring ladle, to conduct spheroidization and primary inoculation by a sandwiching method. The spheroidizing agent and primary inoculant were the same as used in Example 1. When poured into a sprue of a casting mold, 0.1% by mass, as Si equivalent, of a secondary inoculant [powdery Fe—Si alloy inoculant (Stream available from Toyo Denka Kogyo Co. Ltd.)] was added to a target weight of the melt for secondary inoculation. The component compositions of the melts in Example 3 are shown in Table 9.

TABLE 9

| % by mass | C | Si | Mn | P | S | Cu | Mg | Fe[(1)] |
|---|---|---|---|---|---|---|---|---|
| Example 3 | 3.77 | 2.19 | 0.46 | 0.014 | 0.009 | 0.47 | 0.043 | Bal. |
| Com. Ex. 1 | 3.77 | 2.19 | 0.46 | 0.014 | 0.009 | 0.47 | 0.043 | Bal. |

Note:
[(1)]Plus impurity elements.

Casting Mold

Figure 10:
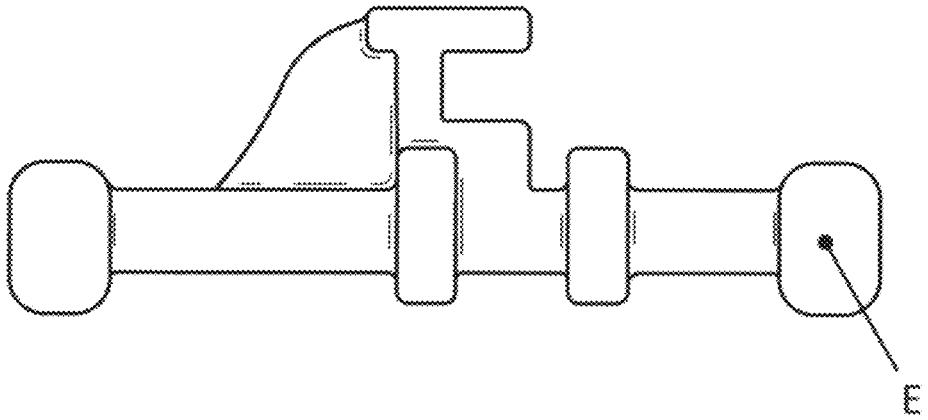
FIG. 10 is a schematic view showing the cast article (spheroidal graphite cast iron) of Example 3.

A gas-permeable, green sand mold was used as a casting mold having a cavity for forming an automobile structure part (support beam) shown in FIG. 10.

Casting

Casting was conducted in the same manner as in Example 1, using a gravity-casting method and a gas-pressing method. The gravity casting was conducted at 1400° C., and the pressure for pressing a melt surface in the cavity was 35 kPa. With the pressing-starting time $t_{p0}$=10 s, and the pressing termination time $t_{pf}$=190 s, the pressing time period $dt_p$ was 180 s. With the eutectic solidification start time $t_{Es}$=35 s, and the eutectic solidification termination time $t_{Ef}$=350 s, the eutectic solidification time period $dt_E$ was 315 s, and the pressing time period $dt_{pE}$ after the start of eutectic solidification (=$t_{pf}-t_{Es}$) was 155 s. Accordingly, a ratio of the pressing time period $dt_{pE}$ after the start of eutectic solidification to the eutectic solidification time period $dt_E$, $dt_{pE}/dt_E$, was 0.492, namely 1/2.0, in Example 3.

Microstructure

Figure 11:
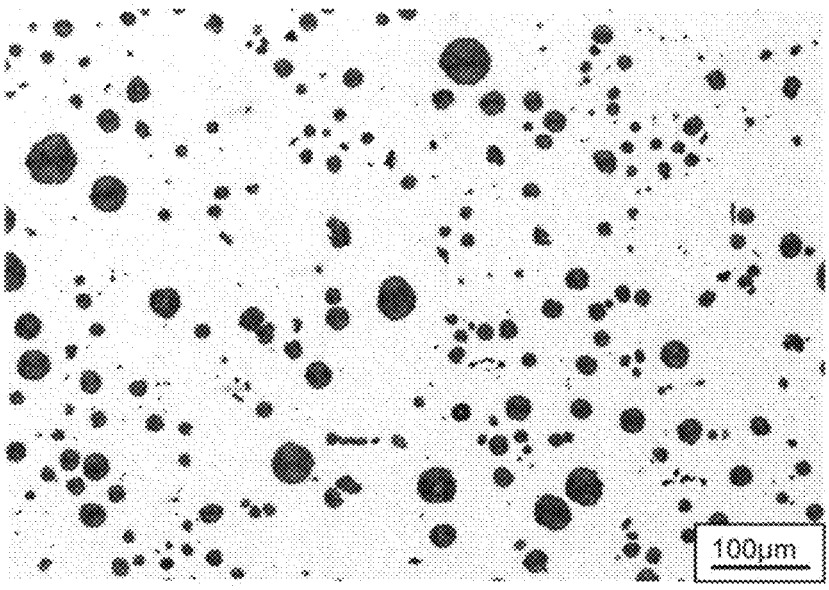
FIG. 11 is an optical photomicrograph showing the observed microstructure of the spheroidal graphite cast iron article of Example 3.
Figure 12:
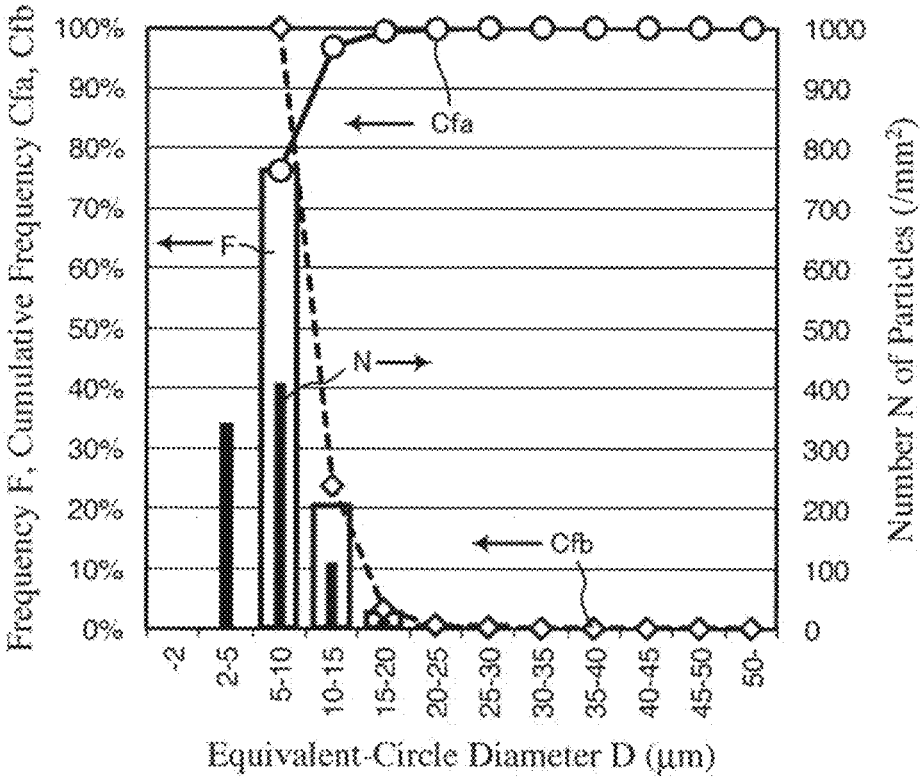
FIG. 12 is a graph showing a particle size distribution of spheroidal graphite observed in a cross section of the spheroidal graphite cast iron article of Example 3.

The microstructure of the cast article (spheroidal graphite cast iron) of Example 3 was observed in the same manner as in Example 1, to evaluate the particle size distribution of spheroidal graphite in the same manner as in Example 1. The observation was conducted near a thickness-direction center in a portion E (thickness: 30 mm) in FIG. 10. Its photomicrograph is shown in FIG. 11, and the number N of spheroidal graphite particles, the frequency F of 5 μm or more, the cumulative frequency Cfa of 5 μm or more, and the reverse cumulative frequency Cfb are shown in Table 6. FIG. 12 is a graph illustrating the data of Table 10.

TABLE 10

| Example 3 | | | | |
|---|---|---|---|---|
| D[(1)] (μm) | N[(2)] (/mm$^2$) | F[(3)] (%) | Cfa[(4)] (%) | Cfb[(5)] (%) |
| -2 | No Data | — | — | — |
| 2-5 | 341 | — | — | — |
| 5-10 | 407 | 76.22 | 76.22 | 100 |
| 10-15 | 110 | 20.60 | 96.82 | 23.78 |
| 15-20 | 14.0 | 2.62 | 99.44 | 3.18 |

TABLE 10-continued

| Example 3 | | | | |
|---|---|---|---|---|
| D(1) (μm) | N(2) (/mm²) | F(3) (%) | Cfa(4) (%) | Cfb(5) (%) |
| 20-25 | 2.00 | 0.37 | 99.81 | 0.56 |
| 25-30 | 1.00 | 0.19 | 100 | 0.19 |
| 30-35 | 0.00 | 0 | 100 | 0 |
| 35-40 | 0.00 | 0 | 100 | 0 |
| 40-45 | 0.00 | 0 | 100 | 0 |
| 45-50 | 0.00 | 0 | 100 | 0 |
| 50- | 0.00 | 0 | 100 | 0 |
| 5- | 534 | | — | |

Note:
(1)D represents an equivalent-circle diameter [x (μm)-y (μm)].
(2)N represents the number of particles.
(3)F represents the frequency of 5 μm or more.
(4)Cfa represents the cumulative frequency of 5 μm or more.
(5)Cfb represents a reverse cumulative frequency.

With respect to spheroidal graphite contained in the spheroidal graphite cast iron of Example 3, $N_{(5\text{-}20)}/N_{(5\text{-})}$, $N_{(30\text{-})}/N_{(5\text{-})}$, and $[N_{(5\text{-}10)}-N_{(15\text{-}20)}]/N_{(5\text{-}10)}$ were determined in the same manner as in Example 1 from the particle size distribution shown in Table 10. The results are shown in Table 12.

Further, the relation between the equivalent-circle diameter D and the cumulative number Nc of particles, and the relation between the equivalent-circle diameter D and the cumulative frequency Cfa in Example 3 were determined in the same manner as in Example 1. The results are shown in Table 11 and FIG. 13. The $D_{max}$ (d100) of spheroidal graphite contained in the spheroidal graphite cast iron of Example 3 is extracted from Table 11, and shown in Table 12.

TABLE 11

| | Equivalent-Circle Diameter D (μm) | Cumulative Number Nc of Particles (/mm²) | Cumulative Frequency of 5 μm or more Cfa (%) |
|---|---|---|---|
| d0 | 5.0 | 1 | 0.1 |
| d10 | 5.6 | 54 | 10 |
| d20 | 6.3 | 107 | 20 |
| d30 | 6.9 | 161 | 30 |
| d40 | 7.5 | 214 | 40 |
| d50 | 7.9 | 267 | 50 |
| d60 | 8.6 | 321 | 60 |
| d70 | 9.5 | 374 | 70 |
| d80 | 10.4 | 428 | 80 |
| d90 | 11.7 | 481 | 90 |
| d95 | 13.7 | 508 | 95 |
| d97 | 15.2 | 518 | 97 |
| d98 | 16.3 | 524 | 98 |
| d99 | 17.3 | 529 | 99 |
| d100 | 29.5 | 534 | 100 |

TABLE 12

| Parameter | Value |
|---|---|
| $N_{(5\text{-})}$ (/mm²) | 534 |
| $N_{(2\text{-}5)}$ (/mm²) | 341 |
| $N_{(5\text{-}20)}/N_{(5\text{-})}$ | 0.994 |
| $N_{(30\text{-})}/N_{(5\text{-})}$ | 0.0 |
| $[N_{(5\text{-}10)}-N_{(15\text{-}20)}]/N_{(5\text{-}10)}$ | 0.966 |
| $D_{max}$ (μm) | 29.5 |

Figure 13:
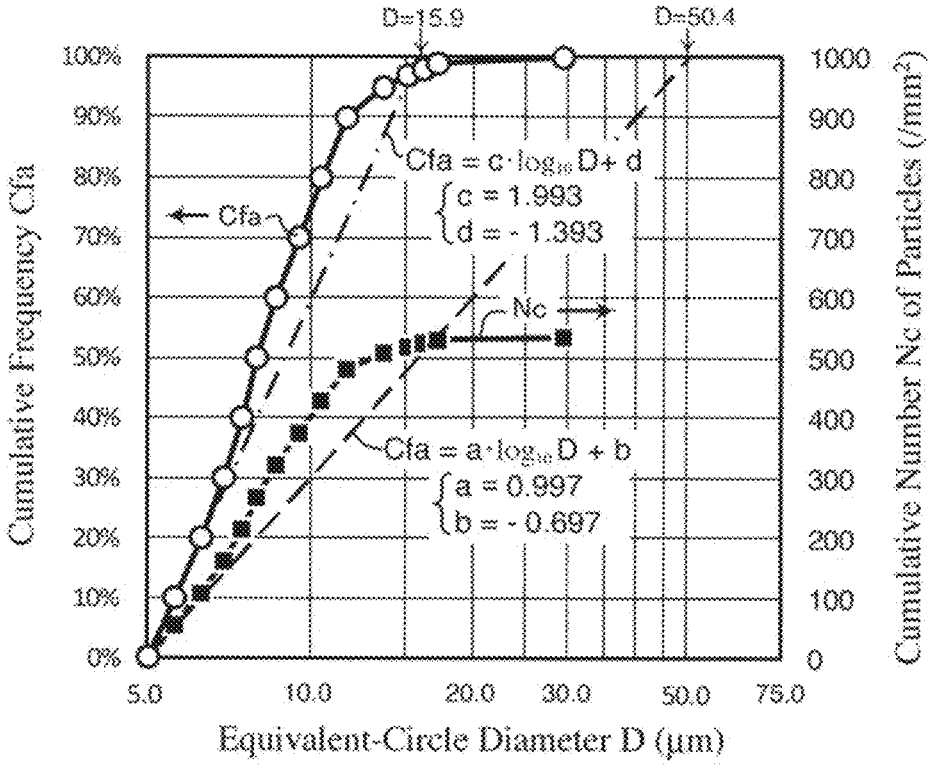
FIG. 13 is a graph showing a particle size distribution of spheroidal graphite observed in a cross section of the spheroidal graphite cast iron article of Example 3.

FIG. 13 shows a chain line expressed by the formula (2): $Cfa=c\cdot\log_{10}D+d$, wherein c=1.993, and b=−1.393, in addition to the broken line expressed by the formula (1). The formula (2) represents a straight line passing the coordinate points (D, Cfa) of (5, 0) and (10, 60), and the equivalent-circle diameter D at an intersection of this straight line and Cfa=100% is 15.9 μm. It is said that the percentage of fine graphite particles is higher in the particle size distribution expressed by the formula (2) than in the particle size distribution expressed by the formula (1). The relation between the equivalent-circle diameter D and Cfa indicates that with respect to the percentage of fine graphite particles, Example 3 is higher than the formula (2) showing a particle size distribution having a higher percentage of fine graphite particles than that of the formula (1) shown by the broken line. The comparison of the chain line expressed by the formula (2) with the curve of Cfa in Example 3 indicates that in Example 3, the n-% particle diameter is substantially in accordance with the formula (2) when Cfa is up to 30%, up to an equivalent-circle diameter of d30, smaller than the formula (2) when Cfa is 30-98%, in an equivalent-circle diameter range of d30 to d98, and larger than the formula (2) when Cfa is 99% or more.

Tensile Test and Charpy Impact Test

Table 13 shows the results of the tensile test (tensile strength, 0.2-% yield strength, and rupture elongation) and the Charpy impact test of the as-cast product of Example 3.

TABLE 13

| No. | 0.2-% Yield Strength (MPa) | Tensile Strength (MPa) | Rupture Elongation (%) | Impact Strength at −30° C. (J/cm²) |
|---|---|---|---|---|
| Example 3 | 432 | 692 | 10.3 | 49 |
| Com. Ex. 1 | 436 | 727 | 9.2 | 20 |

Comparative Example 1

The results of Comparative Example 1 using only gravity casting without a gas-pressing method are compared with those of Example 3. Comparative Example 1 used the same production conditions as in Example 3 except for using no gas-pressing method, using the same melt component composition as in Example 3 as shown in Table 9. The methods of measuring the number and sizes of graphite particles, and the tensile test and Charpy impact test methods are the same as in Example 3.

Microstructure

Figure 14:
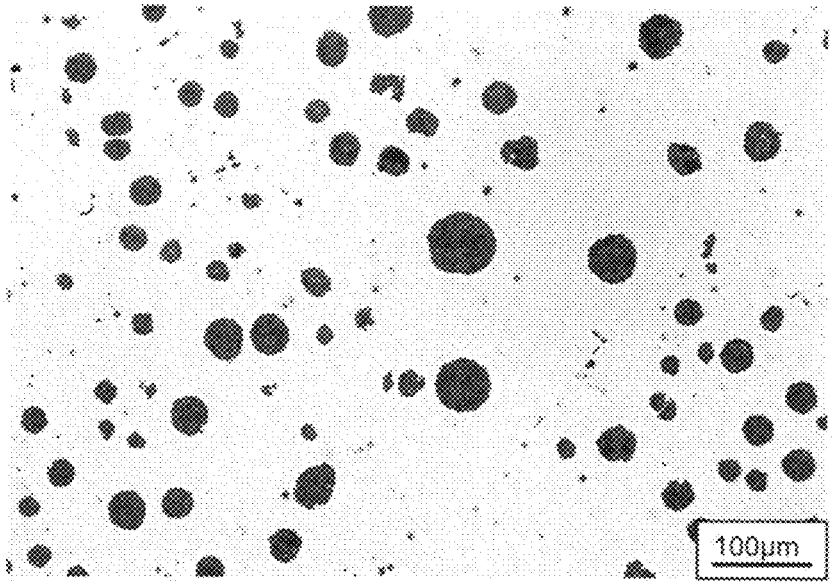
FIG. 14 is an optical photomicrograph showing the observed microstructure of the spheroidal graphite cast iron article of Comparative Example 1.
Figure 15:
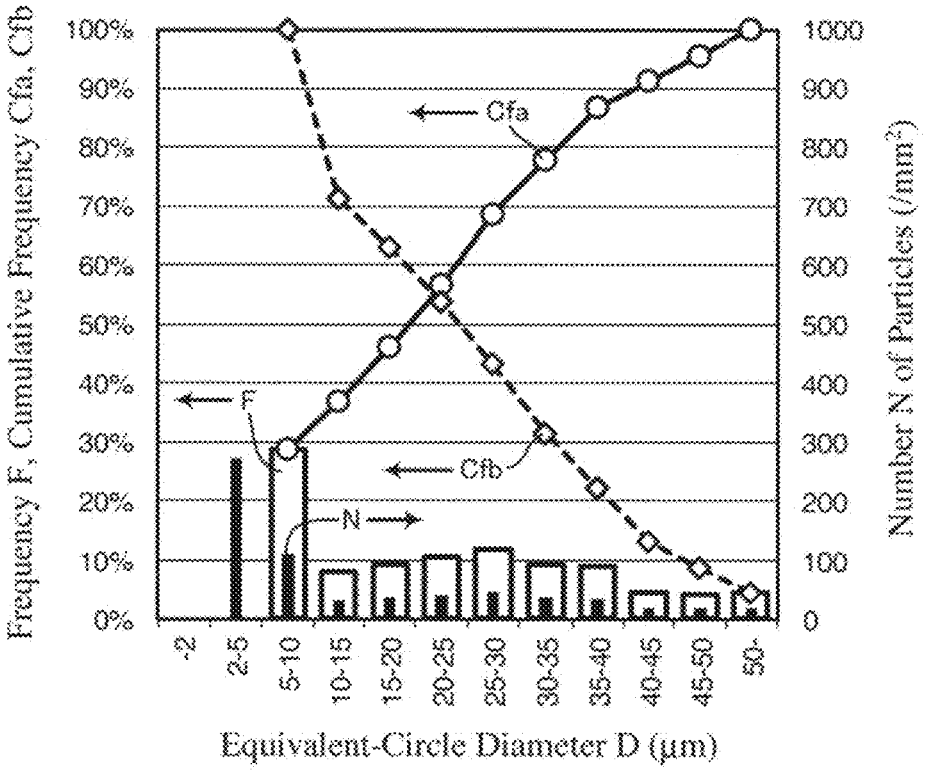
FIG. 15 is a graph showing a particle size distribution of spheroidal graphite observed in a cross section of the spheroidal graphite cast iron article of Comparative Example 1.

The microstructure of the cast article (spheroidal graphite cast iron) of Comparative Example 1 was observed in the same manner as in Example 3, and the particle size distribution of spheroidal graphite was evaluated in the same manner as in Example 3. The observation point was the same as in Example 3. Its photomicrograph is shown in FIG. 14, the number N of spheroidal graphite particles, the frequency F of 5 μm or more, the cumulative frequency Cfa of 5 μm or more, and the reverse cumulative frequency Cfb are shown in Table 14. FIG. 15 is a graph showing the date of Table 14.

TABLE 14

| Comparative Example 1 | | | | |
|---|---|---|---|---|
| D(1) (μm) | N(2) (/mm²) | F(3) (%) | Cfa(4) (%) | Cfb(5) (%) |
| -2 | No Data | — | — | — |
| 2-5 | 272 | — | — | — |

TABLE 14-continued

| Comparative Example 1 | | | | |
|---|---|---|---|---|
| D(1) (μm) | N(2) (/mm²) | F(3) (%) | Cfa(4) (%) | Cfb(5) (%) |
| 5-10 | 109 | 28.76 | 28.76 | 100 |
| 10-15 | 31.0 | 8.18 | 36.94 | 71.24 |
| 15-20 | 35.0 | 9.23 | 46.17 | 63.06 |
| 20-25 | 40.0 | 10.55 | 56.73 | 53.83 |
| 25-30 | 45.0 | 11.87 | 68.60 | 43.27 |
| 30-35 | 35.0 | 9.23 | 77.84 | 31.40 |
| 35-40 | 34.0 | 8.97 | 86.81 | 22.16 |
| 40-45 | 17.0 | 4.49 | 91.29 | 13.19 |
| 45-50 | 16.0 | 4.22 | 95.51 | 8.71 |
| 50- | 17.0 | 4.49 | 100 | 4.49 |
| 5- | 379 | | — | |

Note:
(1)D represents an equivalent-circle diameter [x (μm)-y (μm)].
(2)N represents the number of particles.
(3)F represents the frequency of 5 μm or more.
(4)Cfa represents the cumulative frequency of 5 μm or more.
(5)Cfb represents a reverse cumulative frequency.

With respect to spheroidal graphite contained in the spheroidal graphite cast iron of Comparative Example 1, $N_{(5\text{-}20)}/N_{(5\text{-})}$, $N_{(30\text{-})}/N_{(5\text{-})}$ and $[N_{(5\text{-}10)}-N_{(15\text{-}20)}]/N_{(5\text{-}10)}$ were determined from the particle size distribution shown in Table 14, in the same manner as in Example 3. The results are shown in Table 16.

Further, the relation between the equivalent-circle diameter D and the cumulative number Nc of particles, and the relation between the equivalent-circle diameter D and the cumulative frequency Cfa in Comparative Example 1 were determined in the same manner as in Example 3. The results are shown in Table 15 and FIG. 16. The $D_{max}$ (d100) of spheroidal graphite contained in the spheroidal graphite cast iron of Comparative Example 1 is extracted from Table 15, and shown in Table 16.

TABLE 15

| | Equivalent-Circle Diameter D (μm) | Cumulative Number Nc of Particles (/mm²) | Cumulative Frequency of 5 μm or more Cfa (%) |
|---|---|---|---|
| d0 | 5.0 | 1 | 0.1 |
| d10 | 5.8 | 38 | 10 |
| d20 | 7.6 | 76 | 20 |
| d30 | 10.5 | 114 | 30 |
| d40 | 16.8 | 152 | 40 |
| d50 | 21.2 | 190 | 50 |
| d60 | 25.9 | 228 | 60 |
| d70 | 30.5 | 266 | 70 |
| d80 | 35.9 | 304 | 80 |
| d90 | 42.9 | 342 | 90 |
| d95 | 48.8 | 361 | 95 |
| d97 | 50.9 | 368 | 97 |
| d98 | 52.1 | 372 | 98 |
| d99 | 54.8 | 376 | 99 |
| d100 | 69.1 | 379 | 100 |

TABLE 16

| Parameter | Value |
|---|---|
| $N_{(5\text{-})}$ (/mm²) | 379 |
| $N_{(2\text{-}5)}$ (/mm²) | 272 |
| $N_{(5\text{-}20)}/N_{(5\text{-})}$ | 0.462 |
| $N_{(30\text{-})}/N_{(5\text{-})}$ | 0.314 |
| $[N_{(5\text{-}10)}-N_{(15\text{-}20)}]/N_{(5\text{-}10)}$ | 0.679 |
| $D_{max}$ (μm) | 69.1 |

Figure 16:
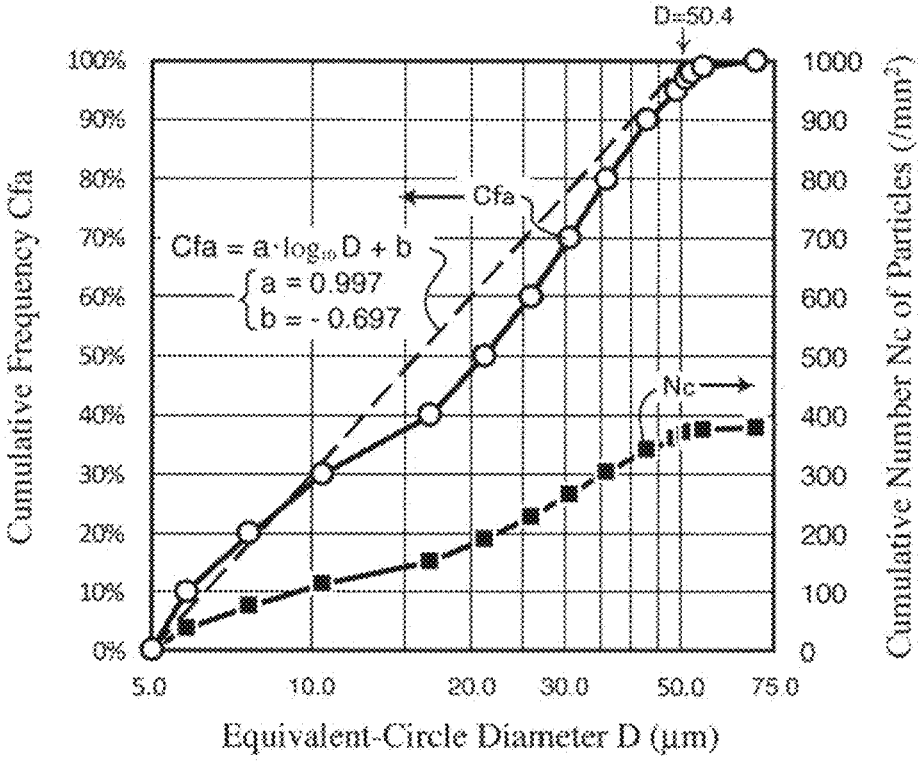
FIG. 16 is a graph showing a particle size distribution of spheroidal graphite observed in a cross section of the spheroidal graphite cast iron article of Comparative Example 1.

The comparison of the broken line shown by the formula (1) with the curve of Cfa in Comparative Example 1 in FIG. 16 revealed that in Comparative Example 1, the n-% particle diameter was smaller than the formula (1) when Cfa was 25%, in an equivalent-circle diameter range of d0 to d25, and larger than the formula (1) when Cfa was in a range of 25% to 100%.

Tensile Test and Charpy Impact Test

Table 13 shows the results of a tensile test (tensile strength, 0.2-% yield strength and rupture elongation) and a Charpy impact test of the as-cast product of Comparative Example 1.

Example 4

Another example using a gravity-casting method and a gas-pressing method according to a preferred embodiment of the present invention will be explained referring to the tables and figures.

Figure 17:
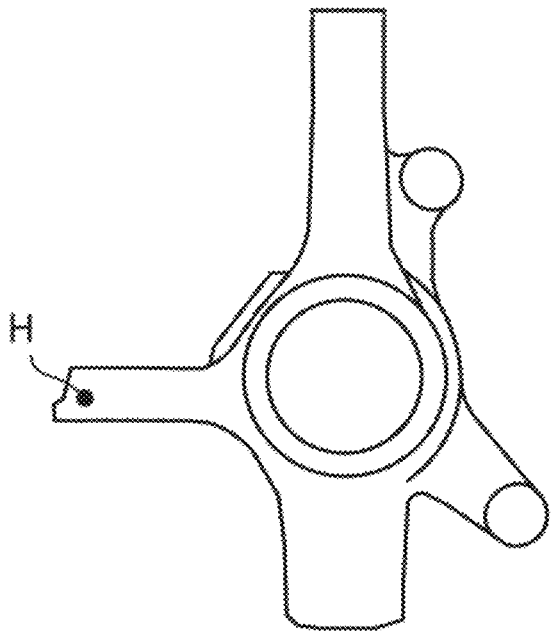
FIG. 17 is a schematic view showing the cast article (spheroidal graphite cast iron) of Example 4.

Example 4 used a casting mold having a cavity for an automobile structure part (steering knuckle) shown in FIG. 17, with the same casting mold material, melt preparation method, casting method and pressing pressure as in Example 1. Example 4 used a melt having the component composition shown in Table 17, with the pressing time period $dt_p$ of 90 s because the pressing-starting time $t_{p0}$ was 6 s, and the pressing termination time $t_{pf}$ was 96 s. Because of the eutectic solidification start time $t_{Es}$=25 s, and the eutectic solidification termination time $t_{Ef}$=160 s, the eutectic solidification time period $dt_E$ was 135 s, and the pressing time period $dt_{pE}$ after the start of eutectic solidification (=$t_{pf}-t_{Es}$) was 71 s. Accordingly, a ratio of the pressing time period $dt_{pE}$ after the start of eutectic solidification to the eutectic solidification time period $dt_E$, $dt_{pE}/dt_E$, in Example 4 was 0.526, namely 1/1.9.

TABLE 17

| % by mass | C | Si | Mn | P | S | Cu | Mg | Fe(1) |
|---|---|---|---|---|---|---|---|---|
| Example 4 | 3.75 | 2.23 | 0.49 | 0.016 | 0.011 | 0.19 | 0.041 | Bal. |

Note:
(1)Including impurity elements.

Figure 18:
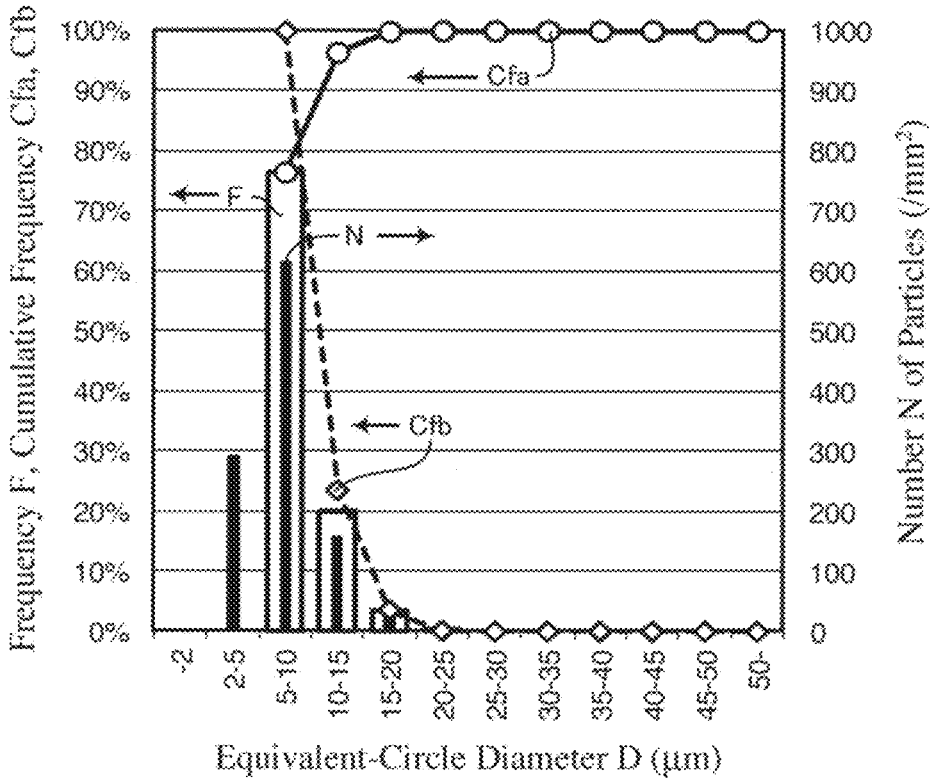
FIG. 18 is a graph showing a particle size distribution of spheroidal graphite observed in a cross section of the spheroidal graphite cast iron article of Example 4.

With respect to spheroidal graphite in the cast article (spheroidal graphite cast iron) of Example 4, the number N of particles, the measurement results of the frequency F of 5 μm or more, the cumulative frequency Cfa of 5 μm or more, and the reverse cumulative frequency Cfb are shown in Table 18. FIG. 18 is a graph showing the data of Table 18. The number of particles was measured nearly at a thickness center of a 20-mm-thick portion shown by H in FIG. 17.

TABLE 18

| Example 4 | | | | |
|---|---|---|---|---|
| D(1) (μm) | N(2) (/mm²) | F(3) (%) | Cfa(4) (%) | Cfb(5) (%) |
| -2 | No Data | — | — | — |
| 2-5 | 292 | — | — | — |
| 5-10 | 614 | 76.46 | 76.46 | 100 |
| 10-15 | 160 | 19.93 | 96.39 | 23.54 |
| 15-20 | 28.0 | 3.49 | 99.88 | 3.61 |
| 20-25 | 1.00 | 0.12 | 100 | 0.12 |
| 25-30 | 0.00 | 0 | 100 | 0 |
| 30-35 | 0.00 | 0 | 100 | 0 |
| 35-40 | 0.00 | 0 | 100 | 0 |
| 40-45 | 0.00 | 0 | 100 | 0 |

TABLE 18-continued

| Example 4 | | | | |
|---|---|---|---|---|
| D(1) (μm) | N(2) (/mm²) | F(3) (%) | Cfa(4) (%) | Cfb(5) (%) |
| 45-50 | 0.00 | 0 | 100 | 0 |
| 50- | 0.00 | 0 | 100 | 0 |
| 5- | 803 | | — | |

Note:
(1)D represents an equivalent-circle diameter [x (μm)-y (μm)].
(2)N represents the number of particles.
(3)F represents the frequency of 5 μm or more.
(4)Cfa represents the cumulative frequency of 5 μm or more.
(5)Cfb represents a reverse cumulative frequency.

With respect to spheroidal graphite contained in the spheroidal graphite cast iron of Example 4, $N_{(5\text{-}20)}/N_{(5\text{-})}$, $N_{(30\text{-})}/N_{(5\text{-})}$ and $[N_{(5\text{-}10)}-N_{(15\text{-}20)}]/N_{(5\text{-}10)}$ were determined from the particle size distribution shown in Table 18, in the same manner as in Example 1. The results are shown in Table 20.

Further, the relation between the equivalent-circle diameter D and the cumulative number Nc of particles, and the relation between the equivalent-circle diameter D and the cumulative frequency Cfa in Example 4 were determined in the same manner as in Example 1. The results are shown in Table 19 and FIG. 19. The $D_{max}$ (d100) of spheroidal graphite contained in the spheroidal graphite cast iron of Example 4 is extracted from Table 19, and shown in Table 20.

TABLE 19

| | Equivalent-Circle Diameter D (μm) | Cumulative Number Nc of Particles (/mm²) | Cumulative Frequency of 5 μm or more Cfa (%) |
|---|---|---|---|
| d0 | 5.0 | 1.00 | 0.1 |
| d10 | 5.6 | 81.0 | 10 |
| d20 | 6.0 | 161 | 20 |
| d30 | 6.5 | 241 | 30 |
| d40 | 7.0 | 322 | 40 |
| d50 | 7.7 | 402 | 50 |
| d60 | 8.4 | 482 | 60 |
| d70 | 9.3 | 563 | 70 |
| d80 | 10.5 | 643 | 80 |
| d90 | 12.4 | 723 | 90 |
| d95 | 14.0 | 763 | 95 |
| d97 | 15.2 | 779 | 97 |
| d98 | 15.7 | 787 | 98 |
| d99 | 16.5 | 795 | 99 |
| d100 | 22.1 | 803 | 100 |

TABLE 20

| Parameter | Value |
|---|---|
| $N_{(5\text{-})}$ (/mm²) | 803 |
| $N_{(2\text{-}5)}$ (/mm²) | 292 |
| $N_{(5\text{-}20)}/N_{(5\text{-})}$ | 0.999 |
| $N_{(30\text{-})}/N_{(5\text{-})}$ | 0.0 |
| $[N_{(5\text{-}10)}-N_{(15\text{-}20)}]/N_{(5\text{-}10)}$ | 0.954 |
| $D_{max}$ (μm) | 22.1 |

Figure 19:
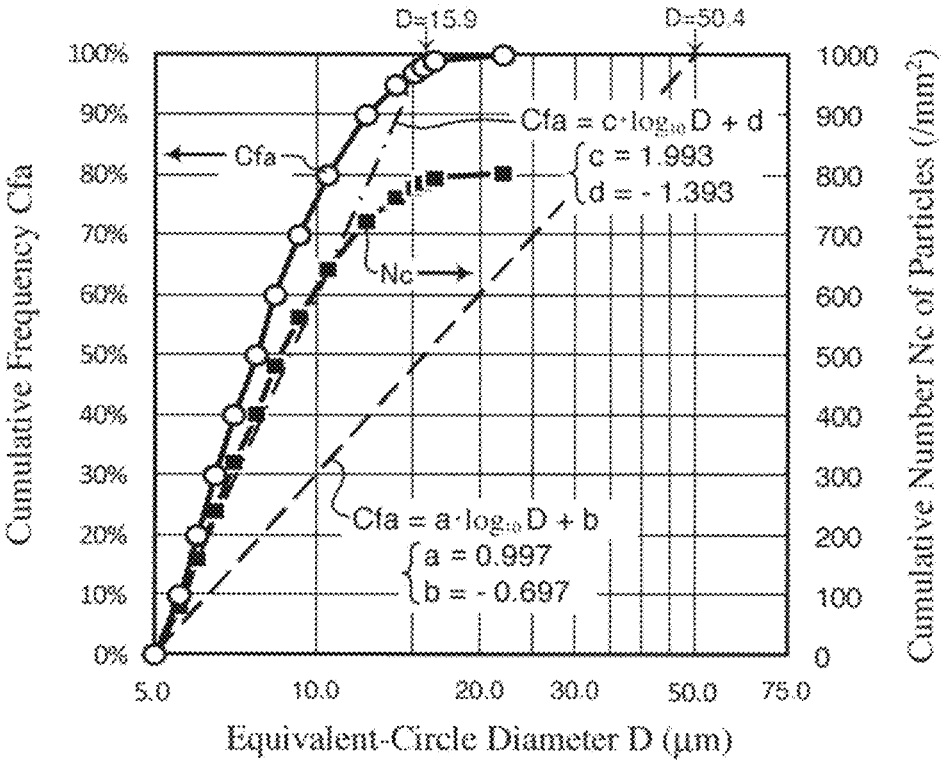
FIG. 19 is a graph showing a particle size distribution of spheroidal graphite observed in a cross section of the spheroidal graphite cast iron article of Example 4.

The relation between the equivalent-circle diameter D and Cfa in FIG. 19 indicates that the percentage of fine graphite particles was higher in Example 4 than that in the particle size distribution shown by the formula (2). Namely, the comparison of a chain line expressed by the formula (2) with the curve of Cfa in Example 4 indicates that in Example 4, the n-% particle diameter was smaller than the formula (2) when Cfa was 97%, in an equivalent-circle diameter range of d0 to d97, and larger than the formula (2) when Cfa was 98% or more.

INDUSTRIAL APPLICABILITY

The spheroidal graphite cast iron of the present invention can be used for various structure parts, and is particularly suitable for structure parts for automobiles because of excellent toughness. For example, it can be used for steering knuckles, crankshafts, support beams, connecting rods, brake bodies, brake brackets, shackles, spring brackets, turbine housings, carriers, differential cases, engine mount brackets, etc.

What is claimed is:

1. A method for producing a cast article of spheroidal graphite cast iron meeting the following conditions:

$$N_{(5\text{-})} \geq 250,$$

$$N_{(5\text{-}20)}/N_{(5\text{-})} \geq 0.6, \text{ and}$$

$$N_{(30\text{-})}/N_{(5\text{-})} \leq 0.2,$$

wherein $N_{(5\text{-})}$, $N_{(5\text{-}20)}$, and $N_{(30\text{-})}$ are the number (/mm²) of graphite particles having equivalent-circle diameters of 5 μm or more, the number (/mm²) of graphite particles having equivalent-circle diameters of 5 μm or more and less than 20 μm, and the number (/mm²) of graphite particles having equivalent-circle diameters of 30 μm or more, respectively, among graphite particles observed in an arbitrary cross section of at least 1 mm²; comprising pouring a melt into a gas-permeable casting mold by gravity-casting, pressing a surface of the melt in the gas-permeable casting mold by a gas at a pressure of 1-100 kPa, before said melt starts eutectic solidification; and solidifying said melt while supplying said gas into said casting mold, wherein said method meets $$0 < dt_{pE}/dt_E \leq 1/2,$$

wherein $dt_E$ represents a time period from the start of eutectic solidification of said melt to the completion of the eutectic solidification, and $dt_{pE}$ represents a time period from the start of eutectic solidification of said melt to the completion of said pressing.

2. The method for producing a cast article according to claim 1, wherein said pressure is 10-50 kPa.

3. The method for producing a cast article according to claim 1, wherein said gas-permeable casting mold is a green sand mold, a shell mold, or a self-hardening mold, constituted by sand particles.

4. The method for producing a cast article according to claim 1, wherein the spheroidal graphite cast iron has a composition comprising by mass 2-4.5% of C, 0.8-2.26% of Si, and 0.010-0.080% of Mg, the balance being Fe and inevitable impurity elements and optionally one or more of S, P, Mn, Cu, Cr, Ni, Mo, W, wherein said graphite particles meet $N_{(2\text{-}5)} \geq 100$, wherein $N_{(2\text{-}5)}$ represents the number (/mm²) of graphite particles having equivalent-circle diameters of 2 μm or more and less than 5 μm, wherein said graphite particles meet $D_{max} \geq 50.4$ μm, wherein $D_{max}$ represents the maximum equivalent-circle diameter of graphite particles, and wherein said graphite particles meet $-0.15 \leq [N_{(5\text{-}10)}-N_{(15\text{-}20)}]/N_{(5\text{-}10)} \leq 0.25$, wherein $N_{(5\text{-}10)}$ represents the number (/mm$^2$) of graphite particles having equivalent-circle diameters of 5 μm or more and less than 10 μm, and $N_{(15-20)}$ represents the number (/mm$^2$) of graphite particles having equivalent-circle diameters of 15 μm or more and less than 20 μm.

5. The method for producing a cast article according to claim 1, wherein said method meets $0<dt_{pE}/dt_E\leq 1/4$.

6. The method for producing a cast article according to claim 1, wherein said method meets $1/4\leq dt_{pE}/dt_E\leq 1/2$.

7. The method for producing a cast article according to claim 1, wherein said method meets $1/4\leq dt_{pE}/dt_E<1/2$.

8. The method for producing a cast article according to claim 1, wherein the gas is supplied to monotonically increase the pressing pressure from the start.

9. A method for producing a cast article of spheroidal graphite cast iron meeting the following conditions:

$$N_{(5-)}\geq 250,$$

$$N_{(5-20)}/N_{(5-)}\geq 0.6, \text{ and}$$

$$N_{(30-)}/N_{(5-)}\leq 0.2,$$

wherein $N_{(5-)}$, $N_{(5-20)}$, and $N_{(30-)}$ are the number (/mm$^2$) of graphite particles having equivalent-circle diameters of 5 μm or more, the number (/mm$^2$) of graphite particles having equivalent-circle diameters of 5 μm or more and less than 20 μm, and the number (/mm$^2$) of graphite particles having equivalent-circle diameters of 30 μm or more, respectively, among graphite particles observed in an arbitrary cross section of at least 1 mm$^2$; comprising pouring a melt into a gas-permeable casting mold by gravity-casting, pressing a surface of the melt in the gas-permeable casting mold by a gas at a pressure of 1-100 kPa, before said melt starts eutectic solidification; and solidifying said melt while supplying said gas into said casting mold, wherein said method meets $$0<dt_{pE}/dt_E\leq 1/1.9,$$

wherein $dt_E$ represents a time period from the start of eutectic solidification of said melt to the completion of the eutectic solidification, and $dt_{pE}$ represents a time period from the start of eutectic solidification of said melt to the completion of said pressing.

10. The method for producing a cast article according to claim 9, wherein said pressure is 10-50 kPa.

11. The method for producing a cast article according to claim 9, wherein said gas-permeable casting mold is a green sand mold, a shell mold, or a self-hardening mold, constituted by sand particles.

12. The method for producing a cast article according to claim 9, wherein the spheroidal graphite cast iron has a composition comprising by mass 2-4.5% of C, 0.8-2.26% of Si, and 0.010-0.080% of Mg, the balance being Fe and inevitable impurity elements and optionally one or more of S, P, Mn, Cu, Cr, Ni, Mo, W, wherein said graphite particles meet $N_{(2-5)}\geq 100$, wherein $N_{(2-5)}$ represents the number (/mm$^2$) of graphite particles having equivalent-circle diameters of 2 μm or more and less than 5 μm, wherein said graphite particles meet $D_{max}\geq 50.4$ μm, wherein $D_{max}$ represents the maximum equivalent-circle diameter of graphite particles, and wherein said graphite particles meet $-0.15\leq[N_{(5-10)}-N_{(15-20)}]/N_{(5-10)}\leq 0.25$, wherein $N_{(5-10)}$ represents the number (/mm$^2$) of graphite particles having equivalent-circle diameters of 5 μm or more and less than 10 μm, and $N_{(15-20)}$ represents the number (/mm$^2$) of graphite particles having equivalent-circle diameters of 15 μm or more and less than 20 μm.

13. The method for producing a cast article according to claim 9, wherein the gas is supplied to monotonically increase the pressing pressure from the start.

* * * * *